US009187701B2

(12) United States Patent
Etter

(10) Patent No.: US 9,187,701 B2
(45) Date of Patent: Nov. 17, 2015

(54) REACTIONS WITH UNDESIRABLE COMPONENTS IN A COKING PROCESS

(71) Applicant: Roger G. Etter, Delaware, OH (US)

(72) Inventor: Roger G. Etter, Delaware, OH (US)

( * ) Notice: Subject to any disclaimer, the term of this patent is extended or adjusted under 35 U.S.C. 154(b) by 0 days.

(21) Appl. No.: 14/074,150

(22) Filed: Nov. 7, 2013

(65) Prior Publication Data

US 2014/0061097 A1 Mar. 6, 2014

Related U.S. Application Data

(63) Continuation of application No. 13/765,449, filed on Feb. 12, 2013, now Pat. No. 8,968,553, which is a continuation of application No. 12/377,188, filed as application No. PCT/US2007/085111 on Nov. 19, 2007, now Pat. No. 7,372,265.

(60) Provisional application No. 60/866,345, filed on Nov. 17, 2006.

(51) Int. Cl.
*C10B 57/12* (2006.01)
*C10B 55/00* (2006.01)
(Continued)

(52) U.S. Cl.
CPC ..... *C10G 11/14* (2013.01); *C10B 55/00* (2013.01); *C10B 57/12* (2013.01); *C10G 9/005* (2013.01);
(Continued)

(58) Field of Classification Search
CPC ..... C10B 55/00; C10B 55/02; C10B 55/04; C10B 57/12
USPC ..... 208/50, 52 R, 53–55, 131–132
See application file for complete search history.

(56) References Cited

U.S. PATENT DOCUMENTS

| | | | |
|---|---|---|---|
| 1,831,719 | A | 11/1931 | Pelzer |
| 1,873,024 | A | 8/1932 | Pelzer |
| RE20,011 | E | 6/1936 | Pelzer |
| 2,881,130 | A | 4/1959 | Pfeiffer et al. |

(Continued)

FOREIGN PATENT DOCUMENTS

| | | |
|---|---|---|
| DE | 19540780 | 5/1996 |
| WO | WO9520637 | 8/1995 |
| WO | WO/2009/103088 | 8/2009 |
| WO | WO2014175978 | 10/2014 |

OTHER PUBLICATIONS

W.R. Grace & Co.-Conn., Guide to Fluid Catalytic Cracking Part Two, copyright 1996, 98 pages.

(Continued)

*Primary Examiner* — Brian McCaig
(74) *Attorney, Agent, or Firm* — Standley Law Group LLP

(57) ABSTRACT

Undesirable components of traditional coking processes are selectively cracked or coked in the coking vessel by injecting an additive into the vapors in the coking vessel. The additive contains catalyst(s), seeding agent(s), excess reactant(s), quenching agent(s), carrier(s), or any combination thereof to modify reaction kinetics to preferentially crack (or coke) these undesirable components that typically have a high propensity to coke, and are often precursors to coke in the coking process. These undesirable components can also be very problematic in downstream catalytic cracking processes, significantly contributing to coke on catalyst and catalyst deactivation. Exemplary embodiments of the present invention also provide methods to (1) decrease coke production, (2) increase liquid transportation fuels, (3) control the coke crystalline structure, and (4) control the quantity and quality of volatile combustible materials (VCMs) in the resulting coke. Pet coke from this process may have unique characteristics with substantial utility.

20 Claims, 5 Drawing Sheets

Figure 1:
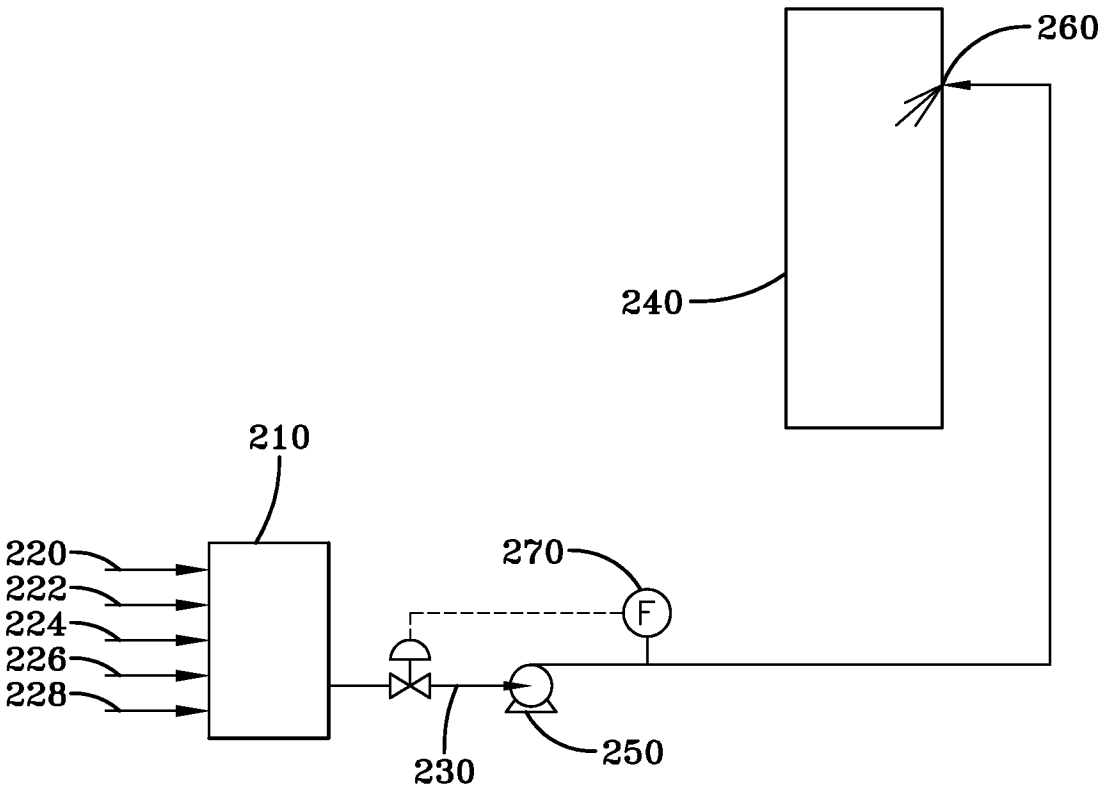

(51) Int. Cl.

| | |
|---|---|
| ***C10G 11/14*** | (2006.01) |
| ***C10G 9/00*** | (2006.01) |
| ***C10G 11/00*** | (2006.01) |
| ***F17D 3/00*** | (2006.01) |
| *C10B 55/02* | (2006.01) |
| *C10B 55/04* | (2006.01) |

(52) U.S. Cl.

CPC *C10G 11/00* (2013.01); *F17D 3/00* (2013.01); *C10G 2300/1059* (2013.01); *C10G 2300/1096* (2013.01); *C10G 2300/701* (2013.01); *C10G 2300/708* (2013.01); *C10G 2300/80* (2013.01); *C10G 2300/805* (2013.01); *C10G 2300/807* (2013.01); *C10G 2400/02* (2013.01); *C10G 2400/04* (2013.01); *C10G 2400/06* (2013.01); *C10G 2400/08* (2013.01); *Y10T 137/0318* (2015.04)

(56) References Cited

U.S. PATENT DOCUMENTS

| | | | |
|---|---|---|---|
| 2,888,393 | A | 5/1959 | Ballard |
| 2,888,395 | A | 5/1959 | Henny |
| 2,905,622 | A | 9/1959 | McCarthy |
| 2,922,755 | A | 1/1960 | Hackley, Jr. |
| 3,382,084 | A | 5/1968 | Folkins et al. |
| 3,617,480 | A | 11/1971 | Keel |
| 3,619,413 | A | 11/1971 | Folkins |
| 3,661,543 | A | 5/1972 | Saxton |
| 3,684,697 | A | 8/1972 | Gamson |
| 3,702,516 | A | 11/1972 | Luckenbach |
| 3,702,816 | A | 11/1972 | Buchmann et al. |
| 3,759,676 | A | 9/1973 | Lahn |
| 3,775,290 | A | 11/1973 | Peterson et al. |
| 3,775,294 | A | 11/1973 | Peterson et al. |
| 3,816,084 | A | 6/1974 | Moser, Jr. et al. |
| 3,842,165 | A | 10/1974 | Grindstaff et al. |
| 3,852,047 | A | 12/1974 | Schlinger et al. |
| 3,896,023 | A | 7/1975 | Ozaki et al. |
| 3,917,564 | A | 11/1975 | Meyers |
| 3,932,587 | A | 1/1976 | Grantham et al. |
| 3,960,701 | A | 6/1976 | Schroeder |
| 4,043,898 | A | 8/1977 | Kegler |
| 4,049,538 | A | 9/1977 | Hayashi et al. |
| 4,055,484 | A | 10/1977 | Blaser et al. |
| 4,096,097 | A | 6/1978 | Yan |
| 4,100,035 | A | 7/1978 | Smith |
| 4,178,229 | A | 12/1979 | McConaghy et al. |
| 4,188,277 | A | 2/1980 | Martin |
| 4,198,380 | A | 4/1980 | Kohl |
| 4,202,868 | A | 5/1980 | Hayashi et al. |
| 4,214,979 | A | 7/1980 | Nakanishi |
| 4,269,696 | A | 5/1981 | Metrailer |
| 4,291,008 | A | 9/1981 | Hsu et al. |
| 4,295,956 | A | 10/1981 | Metrailer |
| 4,302,324 | A | 11/1981 | Chen et al. |
| 4,312,742 | A | 1/1982 | Hayashi |
| 4,326,853 | A | 4/1982 | Sze et al. |
| 4,334,980 | A | 6/1982 | Hsu |
| 4,358,366 | A | 11/1982 | Alford |
| 4,364,741 | A | 12/1982 | Villa |
| 4,369,171 | A | 1/1983 | Grindstaff et al. |
| 4,388,152 | A | 6/1983 | Wasson et al. |
| 4,394,250 | A | 7/1983 | Grossberg |
| 4,399,024 | A | 8/1983 | Fukui |
| 4,406,872 | A | 9/1983 | Kapner et al. |
| 4,441,887 | A | 4/1984 | Funk |
| 4,443,415 | A | 4/1984 | Queneau et al. |
| 4,447,259 | A | 5/1984 | Ohyama et al. |
| 4,455,219 | A | 6/1984 | Janssen et al. |
| 4,466,883 | A | 8/1984 | Eickemeyer |
| 4,478,602 | A | 10/1984 | Kelley et al. |
| 4,479,804 | A | 10/1984 | Chen et al. |
| 4,481,101 | A | 11/1984 | Yan |
| 4,490,171 | A | 12/1984 | Suzuki et al. |
| 4,498,976 | A | 2/1985 | Degnan et al. |
| 4,518,486 | A | 5/1985 | Jansma |
| 4,519,898 | A | 5/1985 | Allan |
| 4,521,277 | A | 6/1985 | Calderon et al. |
| 4,534,951 | A | 8/1985 | Kortovich et al. |
| 4,547,284 | A | 10/1985 | Sze et al. |
| 4,551,232 | A | 11/1985 | Calderon et al. |
| 4,631,025 | A | 12/1986 | Casper et al. |
| 4,666,585 | A | 5/1987 | Figgins et al. |
| 4,797,197 | A | 1/1989 | Mallari |
| 4,828,680 | A | 5/1989 | Green et al. |
| 4,853,106 | A | 8/1989 | Grove et al. |
| 4,874,505 | A | 10/1989 | Bartilucci et al. |
| 4,895,636 | A | 1/1990 | Chen et al. |
| 5,007,987 | A | 4/1991 | Block et al. |
| 5,009,767 | A | 4/1991 | Bartilucci et al. |
| 5,015,362 | A | 5/1991 | Chin |
| 5,034,030 | A | 7/1991 | Miller et al. |
| 5,110,448 | A | 5/1992 | Adams et al. |
| 5,114,564 | A | 5/1992 | Goyal |
| 5,114,566 | A | 5/1992 | Naeger et al. |
| 5,165,902 | A | 11/1992 | Bortz et al. |
| 5,174,891 | A | 12/1992 | Becraft |
| 5,215,557 | A | 6/1993 | Johnson et al. |
| 5,246,680 | A | 9/1993 | Esa |
| 5,258,115 | A | 11/1993 | Heck et al. |
| 5,259,864 | A | 11/1993 | Greenwalt |
| 5,277,795 | A | 1/1994 | Thornhill et al. |
| 5,339,755 | A | 8/1994 | Smith |
| 5,350,503 | A | 9/1994 | Freymeyer et al. |
| 5,439,658 | A | 8/1995 | Johnson et al. |
| 5,470,556 | A | 11/1995 | Samish |
| 5,490,918 | A | 2/1996 | Meek |
| 5,496,729 | A | 3/1996 | Monticello |
| 5,529,599 | A | 6/1996 | Calderon |
| 5,591,326 | A | 1/1997 | Shih |
| 5,635,149 | A | 6/1997 | Klingspor et al. |
| 5,651,948 | A | 7/1997 | Myers et al. |
| 5,954,949 | A | 9/1999 | Ohsol et al. |
| 6,024,863 | A | 2/2000 | LeCours et al. |
| 6,056,882 | A | 5/2000 | Scalliet |
| 6,168,709 | B1 | 1/2001 | Etter |
| 6,169,054 | B1 | 1/2001 | Pereira |
| 6,251,307 | B1 | 6/2001 | LeCours et al. |
| 7,037,408 | B2 | 5/2006 | Wilborn |
| 7,438,786 | B2 | 10/2008 | Malsbury |
| 7,727,382 | B2 | 6/2010 | Sparks |
| 8,206,574 | B2 | 6/2012 | Etter |
| 8,361,310 | B2 | 1/2013 | Etter |
| 8,372,264 | B2 | 2/2013 | Etter |
| 8,372,265 | B2 | 2/2013 | Etter |
| 8,394,257 | B2 | 3/2013 | Etter |
| 2001/0006156 | A1 | 7/2001 | Pereira et al. |
| 2002/0179493 | A1 | 12/2002 | Etter |
| 2004/0173504 | A1 | 9/2004 | Klasnich |
| 2005/0263439 | A1 | 12/2005 | Stark |
| 2006/0032788 | A1 | 2/2006 | Etter |
| 2006/0060506 | A1 | 3/2006 | Siskin et al. |
| 2009/0145810 | A1 | 6/2009 | Etter |
| 2009/0152165 | A1 | 6/2009 | Etter |
| 2009/0209799 | A1 | 8/2009 | Etter |
| 2010/0170827 | A1 | 7/2010 | Etter |
| 2010/0326880 | A1 | 12/2010 | Chakka |
| 2011/0044881 | A1 | 2/2011 | Stansberry |
| 2012/0269685 | A1 | 10/2012 | Etter |
| 2013/0213858 | A1 | 8/2013 | Etter |
| 2013/0213859 | A1 | 8/2013 | Etter |
| 2014/0048445 | A1 | 2/2014 | Etter |
| 2014/0061097 | A1 | 3/2014 | Etter |
| 2014/0082999 | A1 | 3/2014 | Faegh |
| 2014/0097124 | A1 | 4/2014 | Etter |

OTHER PUBLICATIONS

Ellis, Paul J. and Paul A. Christopher, Tutorial: Delayed Coking Fundamentals, Great Lakes Carbon Corporation, Prepared for presentation at the AIChE 1998 Spring National Meeting Mar. 8-12, 1998, 20 pages.

(56) References Cited

OTHER PUBLICATIONS

Fletcher, Peter, Delayed Coking, Chem. Engineer, Sep./Oct(1983), 21-23.
Janssen et al., Improved Coking Design Can Up Liquid Yields, Oil & Gas J. (Jun. 25, 1984) 79-83.
Lieberman, Norman, Shot Coke: Its Origins and Prevention, Oil & Gas J. (Jul. 8, 1985) 45-46.
Lieberman, Norman, Good Operating Techniques Improve Coker Yield, Increase Gas-Oil Production, Oil & Gas J. (Mar. 10, 1986) 53-54.
Lieberman, Norman, Procedure Reduces Coke Cutting Time for Large Drums, Gas & Oil J. (Nov. 24, 1986) 85-86.
Barnett, Jack, Desalters Can Remove More Than Salts and Sediment, Oil & Gas J. (Apr. 11, 1988) 43-49.
Archuletta et al., Cooperative Corrosion Control and Treatment Program Proves Effective, Gas & Oil J. (Aug. 6, 1990) 60-68.
Elliott, John, Design Operation Factors Can Up Coker Liquid Yields, Gas & Oil J. (Feb. 4, 1991) 41-44.
Filtration Method Efficiently Desalts Crude in Commercial Test, Gas & Oil J. (May 17, 1993) 59-60.
Bansal et al., Improve Your Coking Process, Hydrocarbon Processing (Feb. 1994) 63-66.
Stefani, A., Debottleneck Delayed Cokers for Greater Profitability, Hydorcarbon Processing (Jun. 1996) 99-103.
Harris, J.R., Use Desalting for FCC Feedstocks, Hydrocarbon Processing (Aug. 1996) 63-68.
Dickenson, et al., Refiner Options for Converting and Utilizing Heavy Fuel Oil, Hydrocarbon Processing (Feb. 1997) 57-62.
Auxiliary Equipment, Corrosion Focus of Refining Meeting, Oil & Gas J. (Apr. 4, 1994).
Wagoner et al., Burning Profiles for Solid Fuels, Amer. Soc. Mech. Eng. (Aug. 7, 1967) 1-8.
Reid, William, Ash Chemistry and Its Effect in Broiler Furnaces, Elec. Power Res. Inst. (Dec. 2, 1980) 1-13.
Burning Petroleum Coke: Boiler/Complex FGD or Fluid-Bed Combustor?, (Jul. 7, 1983).
Lieberman, Norman, Time for Coking Cycle Can Be Routinely Halved, Oil & Gas J. (Aug. 29, 1983) 39-44.
Delayed Coking, Hydrocarbon Processing (Sep. 1984) 113.
Kronenberger et al., Troubleshooting the Refinery Desalter Operation, Materials Performance (Jul. 1986) 9-17.
Muzio et al., Dry Sorbent Emission Control Technologies, JAPC Assoc. (May 1987) 642-654.
Deepwater Fires 100% Coke, Sells All FGD Gypsoum Product, Power (Oct. 1988).
Lieberman, Norman, Frequently Asked Questions on Coke Quality Answered, Oil & Gas J. (Mar. 27, 1989) 67-69.
Makansi, Jason, Clean Air Act Amendments: The Engineering Response, Power (Jun. 1991) 11-60.
Herzog et al., Feasibility, Modeling and Economics of Sequestering Power Plant CO2 Emissions in the Deep Ocean, Envior. Progress vol. 10 (Feb. 1991) 64-74.
Elliott, J.D., Maximize Distillate Liquid Products, Hydrocarbon Proc. (Jan. 1992) 75-80.
Sulfur Dioxide Control, Steam 40 (1992) Chapter 35.
Fuel Ash Effects on Boiler Design and Operation, Steam 40 (1992) Chapter 20(pp. 1-28).
Sources of Chemical Energy, Steam 40 (1992) Chapter 8.
Burners and Combustion Systems for Pulverized Coal, Steam 40 (1992) Chapter 13.
Kent, James, Handbook of Industrial Chemistry, Published by Van Norstrand Reinhold (1992).
Rittenhouse, R.C., Action Builds on the Road to CAA Compliance (Part II), Power Eng. (Jun. 1992) 43-50.
Batra et al, Desing Process Equipment for Corrosion Control, Chem. Eng. Prog. (May 1993) 68-76.
Livengood et al., FG Technologies for Combined Control of SO2 and NOX, Power Eng. (Jan. 1994) 38-42.
Torrens et al., Electric Utility Response to the Clean Air Act Amendments, Power Eng. (Jan. 1994) 43-47.
Coke Quality, Oil & Gas J. (May 2, 1994) 114-115.
Wolsky et al, CO2 Capture From the Flue Gas of Conventional Fossil-Fuel-Fired Power Plants, Envr. Progress vol. 13 (Aug. 1994) 214-219.
Chue et al., Comparison of Activated Carbon and Zeolite 13X for CO2 Recovery From Flue Gas by Pressure Swing Adsorption, Amer. Chem. Soc. (1995) 591-598.
Akai et al., Performance Evaluation of Fossil Power Plant With CO2 Recovery and Sequestering System, Energy Convers. Mgmt. vol. 36 Nos. 6-9(1995) 801-804.
Coking/Catalytic Cracking/Catalytic Reforming, HydroCarbon Processing (Oct. 1996).
Refining 1996, HydroCarbon (Nov. 1996).
Sincero & G.A. Sincero, Environmental Engineering a Design Approach, Types of Control (625-633).
Bisio & A. Boots, Air Pollution Control Methods, The Wiley Encyclopedia Energy and the Environment (vol. 1), 85-91.
Kiely, Gerard, Environmental Engineering, (344-345) & (757-776).
Handbook of Petroleum Refining Processes, (Jul. 16-Jul. 29).
Delayed Coking, Chapter 5 (52-64).
Kirk-Othmer Ency. of Chem. Tehc. 3rd Ed., vol. 17 (194-219).
Kirk-Othmer Ency. of Chem Tech., 4th Ed., vol. 18 (433-469).
Ency. of Chem. Processing and Design, vol. 10 (1-41).
U.S. Department of Energy, DOE Techline Fossil Energy, New Research Focuses on Reducing Energy Consumption, Improving Environmental Performance of Refinery Coking Process, 2 pp., (Apr. 22, 1999).
Laredo et al., Identification of Naphthenic Acids and Other Corrosivity-Related Characteristics in Crude Oil and Vacuum Gas Oils from a Mexican Refinery, Energy & Fuels (2004, No. 18, 1687-1694).
Wang et al., Removal of naphthenic acids from a vacuum fraction oil with an ammonia solution of ethylene glycol, Fuel, (2006, No. 85, 2489-2493).

REACTIONS WITH UNDESIRABLE COMPONENTS IN A COKING PROCESS

This application is a continuation of U.S. application Ser. No. 13/765,449, filed Feb. 12, 2013, which is a continuation of U.S. application Ser. No. 12/377,188, filed Feb. 11, 2009, now U.S. Pat. No. 8,372,265, which claims priority to PCT Application No. PCT/US2007/085111, filed Nov. 19, 2007, which claims priority to U.S. Provisional Application No. 60/866,345, filed Nov. 17, 2006, each of which is hereby incorporated by reference in its entirety.

FIELD OF THE INVENTION

This invention relates generally to the field of thermal coking processes, and more specifically to modifications of petroleum refining thermal coking processes to selectively and/or catalytically crack or coke undesirable components of the coker recycle and gas oil process streams. 'Undesirable components' generally refer to any components that may be cracked to a more valuable product or coked to enhance the quality and value of the resulting petroleum coke. In many cases, 'undesirable components' more specifically refers to heavy aromatic components in the recycle and gas oil streams that are problematic in downstream processing equipment and product pool blending. Exemplary embodiments of the invention also relates generally to the production of various types of petroleum coke with unique characteristics for fuel, anode, electrode, or other specialty carbon products and markets.

BACKGROUND OF THE INVENTION

Thermal coking processes have been developed since the 1930s to help crude oil refineries process the "bottom of the barrel." In general, modern thermal coking processes employ high-severity, thermal decomposition (or "cracking") to maximize the conversion of very heavy, low-value residuum feeds to lower boiling hydrocarbon products of higher value. Feedstocks for these coking processes normally consist of refinery process streams which cannot economically be further distilled, catalytically cracked, or otherwise processed to make fuel-grade blend streams. Typically, these materials are not suitable for catalytic operations because of catalyst fouling and/or deactivation by ash and metals. Common coking feedstocks include atmospheric distillation residuum, vacuum distillation residuum, catalytic cracker residual oils, hydrocracker residual oils, and residual oils from other refinery units.

There are three major types of modern coking processes currently used in crude oil refineries (and upgrading facilities) to convert the heavy crude oil fractions (or bitumen from shale oil or tar sands) into lighter hydrocarbons and petroleum coke: Delayed Coking, Fluid Coking, and Flexicoking. These thermal coking processes are familiar to those skilled in the art. In all three of these coking processes, the petroleum coke is considered a by-product that is tolerated in the interest of more complete conversion of refinery residues to lighter hydrocarbon compounds, referred to as 'cracked liquids' throughout this discussion. These cracked liquids range from pentanes to complex hydrocarbons with boiling ranges typically between 350 and 950.degrees. F. In all three of these coking processes, the 'cracked liquids' and other products move from the coking vessel to the fractionator in vapor form. The heavier cracked liquids (e.g., gas oils) are commonly used as feedstocks for further refinery processing (e.g., Fluid Catalytic Cracking Units or FCCUs) that transforms them into transportation fuel blend stocks.

Crude oil refineries have regularly increased the use of heavier crudes in their crude blends due to greater availability and lower costs. These heavier crudes have a greater proportion of the 'bottom of the barrel" components, increasing the need for coker capacity. Thus, the coker often becomes the bottleneck of the refinery that limits refinery throughput. Also, these heavier crudes often contain higher concentrations of large, aromatic structures (e.g., asphaltenes and resins) that contain greater concentrations of sulfur, nitrogen, and heavy metals, such as vanadium and nickel. As a result, the coking reactions (or mechanisms) are substantially different and tend to produce a denser, shot (vs. sponge) coke crystalline structure (or morphology) with higher concentrations of undesirable contaminants in the pet coke and coker gas oils. Consequently, these three coking processes have evolved through the years with many improvements in their respective technologies.

Many refineries have relied on technology improvements to alleviate the coker bottleneck. Some refineries have modified their vacuum crude towers to maximize the production of vacuum gas oil (e.g., <1050 degree F.) per barrel of crude to reduce the feed (e.g., vacuum reduced crude or VRC) to the coking process and alleviate coker capacity issues. However, this is not generally sufficient and improvements in coker process technologies are often more effective. In delayed coking, technology improvements have focused on reducing cycle times, recycle rates, and/or drum pressure with or without increases in heater outlet temperatures to reduce coke production and increase coker capacity. Similar technology improvements have occurred in the other coking processes, as well.

In addition, coker feedstocks are often modified to alleviate safety issues associated with shot coke production or 'hot spots' or steam 'blowouts' in cutting coke out of the coking vessel. In many cases, decanted slurry oil, heavy cycle oil, and/or light cycle oil from the FCCU are added to the coker feed to increase sponge coke morphology (i.e., reduce shot coke production). This increase in sponge coke is usually sufficient to alleviate the safety problems associated with shot coke (e.g., roll out of drum, plugged drain pipes, etc.). Also, the increase in sponge coke may provide sufficient porosity to allow better cooling efficiency of the quench to avoid 'hot spots' and steam 'blowouts' due to local areas of coke that are not cooled sufficiently before coke cutting. However, the addition of these materials to coker feed reduces coking process capacities.

Unfortunately, many of these technology improvements have substantially decreased the quality of the resulting pet coke. Most of the technology improvements and heavier, sour crudes tend to push the pet coke from porous 'sponge' coke to 'shot' coke (both are terms of the art) with higher concentrations of undesirable impurities: Sulfur, nitrogen, vanadium, nickel, and iron. In some refineries, the shift in coke quality may require a major change in coke markets (e.g., anode to fuel grade) and dramatically decrease coke value. In other refineries, the changes in technology and associated feed changes have decreased the quality of the fuel grade coke with lower volatile matter (VM), gross heating value (GHV), and Hardgrove Grindability Index (GHI). All of these factors have made the fuel grade coke less desirable in the United States, and much of this fuel grade coke is shipped overseas, even with a coal-fired utility boiler on adjacent property. In this manner, the coke value is further decreased.

More importantly, many of these coker technology improvements have substantially reduced the quality of the gas oils that are further processed in downstream catalytic cracking units. That is, the heaviest or highest boiling components of the coker gas oils (often referred to as the 'heavy tail' in the art) are greatly increased in many of these refineries (particularly with heavier, sour crudes). In turn, these increased 'heavy tail' components cause significant reductions in the efficiencies of downstream catalytic cracking units. In many cases, these 'heavy tail' components are primarily polycyclic aromatic hydrocarbons (or PAHs) that have a high propensity to coke and contain much of the remaining, undesirable contaminants of sulfur, nitrogen, and metals. In downstream catalytic cracking units (e.g., FCCUs), these undesirable contaminants of the 'heavy tail' components may significantly increase contaminants in downstream product pools, consume capacities of refinery ammonia recovery/sulfur plants, and increase emissions of sulfur oxides and nitrous oxides from the FCCU regenerator. In addition, these problematic 'heavy tail' components of coker gas oils may significantly deactivate cracking catalysts by increasing coke on catalyst, poisoning of catalysts, and/or blockage or occupation of active catalyst sites. Also, the increase in coke on catalyst may require a more severe regeneration, leading to suboptimal heat balance and catalyst regeneration. Furthermore, the higher severity catalyst regeneration often increases FCCU catalyst attrition, leading to higher catalyst make-up rates, and higher particulate emissions from the FCCU. As a result, not all coker gas oil is created equal. In the past, refinery profit maximization computer models (e.g., Linear Programming Models) in many refineries assumed the same value for gas oil, regardless of quality. This tended to maximize gas oil production in the cokers, even though it caused problems and decreased efficiencies in downstream catalytic cracking units. Some refineries are starting to put vectors in their models to properly devalue these gas oils that reduce the performance of downstream process units.

SUMMARY OF THE INVENTION

Accordingly, one exemplary embodiment of the present invention may provide control of the amounts of these problematic components in the coker recycle to the coker heater and/or 'heavy tail' components going to the fractionators of these coking processes and into the resulting gas oils of the coking processes, while maintaining high coker process capacities. By doing so, an exemplary embodiment of the present invention may significantly reduce catalyst deactivation in downstream catalytic units (cracking, hydrotreating, and otherwise) by significantly reducing coke on catalyst and the presence of contaminants that poison or otherwise block or occupy catalyst reaction sites. An exemplary embodiment of the present invention may more effectively use the recycle and/or gas oil 'heavy tail' components by (1) selective catalytic cracking them to increase 'cracked liquids' yields and/or (2) selective catalytic coking of them in a manner that improves the quality of the pet coke for anode, electrode, fuel, or specialty carbon markets. In addition, an exemplary embodiment of the present invention may reduce excess cracking of hydrocarbon vapors (commonly referred to as 'vapor overcracking' in the art) by quenching such cracking reactions, that convert valuable 'cracked liquids' to less valuable gases (butanes and lower) that are typically used as fuel (e.g., refinery fuel gas).

One exemplary embodiment of the present invention selectively cracks or cokes the highest boiling hydrocarbons in the product vapors to reduce coking and other problems in the coker and downstream units. An exemplary embodiment of the present invention may also reduce vapor overcracking in the coker product vapors. Both of these properties of an exemplary embodiment of the present invention may lead to improved yields, quality, and value of the coker products.

In addition, an exemplary embodiment of the present invention may provide a superior means to increase coking process capacity without sacrificing coker gas oil quality. In fact, an exemplary embodiment of the present invention may improve gas oil quality, the quality of the petroleum coke, and the quality of downstream products, while increasing coker capacity. The increase in coking capacity also leads to an increase in refinery throughput capacity in refineries where the coking process is the refinery bottleneck.

An exemplary embodiment of the present invention may increase sponge coke morphology to avoid safety issues with shot coke production and 'hot spots' and steam 'blowouts' during coke cutting. In many cases, this may be done without using valuable capacity to add slurry oil or other additives to the coker feed to achieve these objectives.

In addition, an exemplary embodiment of the present invention may also be used to enhance the quality of the petroleum coke by selective catalytic coking of the highest boiling hydrocarbons in the coke product vapors to coke with preferred quantities and qualities of the volatile combustible materials (VCMs) contained therein.

An exemplary embodiment of the present invention may also allow crude slate flexibility for refineries that want to increase the proportion of heavy, sour crudes without sacrificing coke quality, particularly with refineries that currently produce anode grade coke. Furthermore, an exemplary embodiment of the present invention may reduce shot coke in a manner that may improve coke quality sufficiently to allow sales in the anode coke market.

Finally, an exemplary embodiment of the present invention may provide a superior means to improve the coking process performance, operation, and maintenance, as well as the performance, operation, and maintenance of downstream catalytic processing units.

All of these factors potentially improve the overall refinery profitability. Further objects and advantages of this invention will become apparent from consideration of the drawings and ensuing descriptions.

It has been discovered that an additive may be introduced into the coking vessel of traditional coking processes to reduce the amount of the highest boiling point materials in the product vapors from the primary cracking and coking reaction zone(s), which would otherwise pass through as recycle to the coke process heater and/or to the fractionation portion of the coking process. This additive selectively removes these highest boiling components from the product vapors in a manner that encourages further conversion (e.g., cracking or coking) of these materials in the coking vessel. Minor changes in coking process operating conditions may enhance the effectiveness of the additive package. The amount of high boiling point materials that are converted in this manner is dependent on (1) the quality and quantity of the additive package, (2) the existing design and operating conditions of the particular coking process, (3) the types and degree of changes in the coking process operating conditions, and (4) the coking process feed characteristics.

Typically, these highest boiling point materials in the product vapors have the highest molecular weight, have the highest propensity to coke, and are comprised primarily of polycyclic aromatic hydrocarbons (PAHs). These PAHs (or simply 'heavy aromatics') typically come from the thermal cracking of asphaltenes, resins, and other aromatics in the coker feed. The highest boiling point materials have traditionally ended up in the coker recycle, where it often would coke in the heater or possibly crack some additional side chains. However, with minimal recycle rates to increase coker capacities, most of these materials are destined to be the highest boiling components of the heavy coker gas oil, though some will still end up in the coker recycle. In other words, the coker operator may modify the coker operation to affect the fate of these highest boiling components: recycle vs. 'heavy tail' of the heavy coker gas oil. (For simplicity, the highest boiling materials in the product vapors may be referred to as gas oil 'heavy tail' components throughout the remaining discussion, even though some of these materials may go into the coker recycle stream). Furthermore, many other coking process technology improvements have increased the quantity and boiling points of these materials in the gas oil and substantially decreased the quality of the gas oils that are further processed in downstream catalytic cracking units. That is, the heaviest or highest boiling components of the coker gas oils (often referred to as the 'heavy tail' in the art) are greatly increased in many of these refineries (particularly with heavier, sour crudes). These increased 'heavy tail' gas oil components cause significant reductions in the efficiencies of downstream catalytic cracking units. In many cases, these 'heavy tail' components contain much of the remaining, undesirable contaminants of sulfur, nitrogen, and metals. In downstream catalytic units, these additional 'heavy tail' components tend to significantly deactivate cracking catalysts by increasing coke on catalyst and/or poisoning of catalysts via blockage or occupation of active sites. In addition, these problematic 'heavy tail' components of coker gas oils also may increase contaminants in downstream product pools, consume capacities of refinery ammonia recovery and sulfur plants, and increase FCCU catalyst attrition, catalyst make-up rates, and environmental emissions.

Selective, catalytic conversion of the highest boiling point materials in the coking process product vapors (coker recycle and/or 'heavy tail' of the heavy coker gas oil) may be accomplished with an exemplary embodiment of the present invention in varying degrees. That is, incremental conversion of more 'heavy tail' components may be achieved by incremental addition of the additive package. In other words, the higher the quantity and/or quality of the additive package, the greater the 'heavy tail' components and recycle materials converted, which lowers the heavy coker gas oil end point. The selective conversion of these heavy aromatic components may be optimized in an exemplary embodiment of the present invention by (1) proper design and quantity of the additive package and (2) enhancement via changes in the coking process operating conditions.

Said additive package comprises of (1) catalyst(s), (2) seeding agent(s), (3) excess reactant(s), (4) quenching agent(s), (5) carrier fluid(s), or (6) any combination thereof. The optimal design of additive package may vary considerably from refinery to refinery due to differences including, but not limited to, coker feed blends, coking process design & operating conditions, coker operating problems, refinery process scheme & downstream processing of the heavy coker gas oil, and the pet coke market & specifications.

Catalyst(s):

In general, the catalyst comprises any chemical element(s) or chemical compound(s) that reduce the energy of activation for the initiation of the catalytic cracking or coking reactions of the high boiling point materials (e.g., polycyclic aromatic hydrocarbons: PAHs) in the vapors in the coke drum. The catalyst may be designed to favor cracking or coking reactions and/or provide selectivity in the types of PAHs that are cracked or coked. In addition, the catalyst may be designed to aid in coking PAHs to certain types of coke, including coke morphology, quality & quantity of volatile combustible materials (VCMs), concentrations of contaminants (e.g., sulfur, nitrogen, and metals), or combinations thereof. Finally, the catalyst may be designed to preferentially coke via an exothermic, asphaltene polymerization reaction mechanism (vs. endothermic, free-radical coking mechanism). In this manner, the temperature of coke drum may increase, and potentially increase the level of thermal and/or catalytic cracking or coking.

Characteristics of this catalyst typically include a catalyst substrate with a chemical compound or compounds that perform the function stated above. In many cases, the catalyst will have acid catalyst sites that initiate the propagation of positively charged organic species called carbocations (e.g., carbonium and carbenium ions), which participate as intermediates in the coking and cracking reactions. Since both coking and cracking reactions are initiated by the propagation of these carbocations, catalyst substrates that promote a large concentration of acid sites are generally appropriate. Also, the porosity characteristics of the catalyst would preferably allow the large, aromatic molecules easy access to the acid sites (e.g., Bronsted or Lewis). For example, fluid catalytic cracking catalyst for feeds containing various types of residua often have higher mesoporosity to promote access to the active catalyst sites. In addition the catalyst is preferably sized sufficiently large (e.g., >40 microns) to avoid entrainment in the vapors exiting the coke drum. Preferably, the catalyst and condensed heavy aromatics have sufficient density to settle to the vapor/liquid interface. In this manner, the settling time to the vapor/liquid interface may provide valuable residence time in cracking the heavy aromatics, prior to reaching the vapor/liquid interface. For heavy aromatics with the highest propensities to coke, the catalytic coking may take place during this settling period and/or after reaching the vapor/liquid interface. At the vapor/liquid interface, the catalyst may continue promoting catalytic cracking and/or coking reactions to produce desired cracked liquids and coke (e.g., asphaltene polymerization). Sizing the catalyst (e.g., 40 to >200 microns) to promote fluidization for the catalyst in the coking vessel may enhance the residence time of the catalyst in the vapor zone.

Many types of catalysts may be used for this purpose. Catalyst substrates may be comprised of various porous natural or man-made materials, including (but should not be limited to) alumina, silica, zeolite, activated carbon, crushed coke, or combinations thereof. These substrates may also be impregnated or activated with other chemical elements or compounds that enhance catalyst activity, selectivity, or combinations thereof. These chemical elements or compounds may include (but should not be limited to) nickel, iron, vanadium, iron sulfide, nickel sulfide, cobalt, calcium, magnesium, molybdenum, sodium, associated compounds, or combinations thereof. For selective coking, the catalyst will likely include nickel, since nickel strongly enhances coking. For selective cracking, many of the technology advances for selectively reducing coking may be used. Furthermore, increased levels of porosity, particularly mesoporosity, may be beneficial in allowing better access by these larger molecules to the active sites of the catalyst. Though the catalyst in the additive may improve cracking of the heavy aromatics to lighter liquid products, the catalyst ultimately ends up in the coke. As such, the preferred catalyst formulation would initially crack heavy aromatics to maximize light products (e.g., cracked liquids) from gas oil 'heavy tail' components, but ultimately promote the coking of other heavy aromatics to alleviate pitch materials (with a very high propensity to coke vs. crack) in the coke that cause 'hot spots.' It is anticipated that various catalysts will be designed for the purposes above, particularly catalysts to achieve greater cracking of the highest boiling point materials in the coking process product vapors. In many cases, conversion of the highest boiling point product vapors to coke is expected to predominate (e.g., >70 Wt. %) due to their high propensity to coke. However, with certain chemical characteristics of these materials and properly designed catalysts, substantial catalytic conversion of these materials to cracked liquids may be accomplished (e.g., >50 Wt. %).

The optimal catalyst or catalyst combinations for each application will often be determined by various factors, including (but not limited to) cost, catalyst activity and catalyst selectivity for desired reactions, catalyst size, and coke specifications (e.g., metals). For example, coke specifications for fuel grade coke typically have few restrictions on metals, but low cost may be the key issue. In these applications, spent or regenerated FCCU catalysts or spent, pulverized, and classified hydrocracker catalysts (sized to prevent entrainment) may be the most preferred. On the other hand, coke specifications for anode grade coke often have strict limits for sulfur and certain metals, such as iron, silicon, and vanadium. In these applications, cost is not as critical. Thus, new catalysts designed for high catalyst activity and/or selectivity may be preferred in these applications. Alumina or activated carbon (or crushed coke) impregnated with nickel may be most preferred for these applications, where selective coking is desirable.

The amount of catalyst used will vary for each application, depending on various factors, including the catalyst's activity and selectivity, coke specifications and cost. In many applications, the quantity of catalyst will be less than 15 weight percent of the coker feed. Most preferably, the quantity of catalyst would be between 0.5 weight percent of the coker feed input to 3.0 weight percent of the coker feed input. Above these levels, the costs will tend to increase significantly, with diminishing benefits per weight of catalyst added. As described, this catalyst may be injected into the vapors exiting the coking vessel (e.g., above the vapor/liquid interface in the coke drum during the coking cycle of the delayed coking process) by various means, including pressurized injection with or without carrier fluid(s): hydrocarbon(s), oil(s), inorganic liquids, water, steam, nitrogen, or combinations thereof.

Injection of cracking catalyst alone may cause undesirable effects in the coker product vapors. That is, injection of a catalyst without excess reactant(s), quenching agent(s), or carrier oil, may actually increase vapor overcracking and cause negative economic impacts.

Seeding Agent(s):

In general, the seeding agent comprises any chemical element(s) or chemical compound(s) that enhance the formation of coke by providing a surface for the coking reactions and/or the development of coke crystalline structure (e.g., coke morphology) to take place. The seeding agent may be a liquid droplet, a semi-solid, solid particle, or a combination thereof. The seeding agent may be the catalyst itself or a separate entity. Sodium, calcium, iron, and carbon particles (e.g., crushed coke or activated carbon) are known seeding agents for coke development in refinery processes. These and other chemical elements or compounds may be included in the additive to enhance coke development from the vapors in the coking vessel.

The amount of seeding agent(s) used will vary for each application, depending on various factors, including (but not limited to) the amount of catalyst, catalyst activity and selectivity, coke specifications and cost. In many applications, catalytic cracking will be more desirable than catalytic coking. In these cases, seeding agents that enhance catalytic coking will be minimized, and the catalyst will be the only seeding agent. However, in some cases, little or no catalyst may be desirable in the additive. In such cases, the amount of seeding agent will be less than 15 weight percent of the coker feed. Most preferably, the quantity of seeding agent would be between 0.5 weight percent of the coker feed input to 3.0 weight percent of the coker feed input. In many cases, the amount of seeding agent is preferably less than 3.0 weight percent of the coker feed. As described, this seeding agent may be injected into the coking vessel (e.g., above the vapor/liquid interface in the coke drum during the coking cycle of the delayed coking process) by various means, including (but not limited to) pressurized injection with or without carrier fluid(s): hydrocarbon(s), oil(s), inorganic liquids, water, steam, nitrogen, or combinations thereof.

Excess Reactant(s):

In general, the excess reactant comprises of any chemical element(s) or chemical compound(s) that react with the heavy aromatics or PAHs to form petroleum coke. In the additive, the excess reactant may be a liquid, a semi-solid, solid particle or a combination thereof. Preferably, the excess reactants of choice are carbon or aromatic organic compounds. However, availability or cost issues may make the use of existing process streams with high aromatics content desirable, preferably over 50 weight percent aromatics. In addition, the characteristics of the excess reactant would preferably include (but not require), high boiling point materials, preferably greater than 800 degrees Fahrenheit and high viscosity, preferably greater than 5000 centipoise.

Various types of excess reactants may be used for this purpose. Ideally, the excess reactant would contain very high concentrations of chemical elements or chemical compounds that react directly with the heavy aromatics in the vapors. However, in many cases, the practical choice for excess reactant would be decanted slurry oil from the refinery's Fluid Catalytic Cracking Unit (FCCU). In certain cases, the slurry oil may still contain spent FCCU catalyst (i.e., not decanted). Also, slurry oil could be brought in from outside the refinery (e.g., nearby refinery). Other excess reactants would include, but should not be limited to, gas oils, extract from aromatic extraction units (e.g., phenol extraction unit in lube oil refineries), coker feed, bitumen, other aromatic oils, crushed coke, activated carbon, or combinations thereof. These excess reactants may be further processed (e.g., distillation) to increase the concentration of desired excess reactants components (e.g., aromatic compounds) and reduce the amount of excess reactant required and/or improve the reactivity, selectivity, or effectiveness of excess reactants with the targeted PAHs.

The amount of excess reactant used will vary for each application, depending on various factors, including (but not limited to) the amount of catalyst, catalyst activity and selectivity, coke specifications and cost. In many applications, the quantity of excess reactant will be sufficient to provide more than enough moles of reactant to coke all moles of heavy aromatics or PAHs that are not cracked to more valuable liquid products. Preferably, the molar ratio of excess reactant to uncracked PAHs would be 1:1 to 3:1. However, in some cases, little or no excess reactant may be desirable in the additive. In many cases, the amount of excess reactant will be less than 15 weight percent of the coker feed. Most preferably, the quantity of excess reactant would be between 0.5 weight percent of the coker feed input to 3.0 weight percent of the coker feed input. As described, this excess reactant may be injected into the coking vessel (e.g., above the vapor/liquid interface in the coke drum during the coking cycle of the delayed coking process) by various means, including (but not limited to) pressurized injection with or without carrier fluid(s): gas oils hydrocarbon(s), oil(s), inorganic liquids, water, steam, nitrogen, or combinations thereof.

Carrier Fluid(s):

In general, a carrier fluid comprises any fluid that makes the additive easier to inject into the coking vessel. The carrier may be a liquid, gas, hydrocarbon vapor, or any combination thereof. In many cases, the carrier will be a fluid available at the coking process, such as gas oils or lighter liquid process streams. In many cases, gas oil at the coking process is the preferable carrier fluid. However, carriers would include, but should not be limited to, gas oils, other hydrocarbon(s), other oil(s), inorganic liquids, water, steam, nitrogen, or combinations thereof.

The amount of carrier used will vary for each application, depending on various factors, including (but not limited to) the amount of catalyst, catalyst activity and selectivity, coke specifications and cost. In many applications, little or no carrier is actually required, but desirable to make it more practical or cost effective to inject the additive into the coking vessel. The quantity of carrier will be sufficient to improve the ability to pressurize the additive for injection via pump or otherwise. In many cases, the amount of excess reactant will be less than 15 weight percent of the coker feed. Most preferably, the quantity of excess reactant would be between 0.5 weight percent of the coker feed input to 3.0 weight percent of the coker feed input. As described, this carrier may help injection of the additive into the coking vessel (e.g., above the vapor/liquid interface in the coke drum during the coking cycle of the delayed coking process) by various means, including (but not limited to) pressurized injection with or without carrier fluid(s): gas oils hydrocarbon(s), oil(s), inorganic liquids, water, steam, nitrogen, or combinations thereof.

Quenching Agent(s):

In general, a quenching agent comprises any fluid that has a net effect of further reducing the temperature of the vapors exiting the coking vessel. The quenching agent(s) may be a liquid, gas, hydrocarbon vapor, or any combination thereof. Many refinery coking processes use a quench in the vapors downstream of the coking vessel (e.g., coke drum). In some cases, this quench may be moved forward into the coking vessel. In many cases, a commensurate reduction of the downstream quench may be desirable to maintain the same heat balance in the coking process. In many cases, gas oil available at the coking process will be the preferred quench. However, quenching agents would include, but should not be limited to, gas oils, FCCU slurry oils, FCCU cycle oils, other hydrocarbon(s), other oil(s), inorganic liquids, water, steam, nitrogen, or combinations thereof.

The amount of quench used will vary for each application, depending on various factors, including (but not limited to) the temperature of the vapors exiting the coking vessel, the desired temperature of the vapors exiting the coking vessel, and the quenching effect of the additive without quench, characteristics and costs of available quench options. In many applications, the quantity of quench will be sufficient to finish quenching the vapors from the primary cracking and coking zone(s) in the coking vessel to the desired temperature. In some cases, little or no quench may be desirable in the additive. In many cases, the amount of quench will be less than 15 weight percent of the coker feed. Most preferably, the quantity of quench would be between 0.5 weight percent of the coker feed input to 3.0 weight percent of the coker feed input. As described, this quench may be injected into the coking vessel (e.g., above the vapor/liquid interface in the coke drum during the coking cycle of the delayed coking process) as part of the additive by various means, including (but not limited to) pressurized injection with or without carrier fluid(s): gas oils hydrocarbon(s), oil(s), inorganic liquids, water, steam, nitrogen, or combinations thereof.

Additive Combination and Injection:

The additive would combine the 5 components to the degree determined to be desirable in each application. The additive components would be blended, preferably to a homogeneous consistency, and heated to the desired temperature (e.g., heated, mixing tank). For example, the desired temperature (>150 degrees F.) of the mixture may need to be increased to maintain a level of viscosity for proper pumping characteristics and fluid nozzle atomization characteristics. The additive, at the desired temperature and pressure, would then be pressurized (e.g., via pump) and injected (e.g., via injection nozzle) into the coking vessel at the desired level above the primary cracking and coking zones. In many cases, insulated piping will be desirable to keep the additive at the desired temperature. Also, injection nozzles will be desirable in many cases to evenly distribute the additive across the cross sectional profile of the product vapor stream exiting the coking vessel. The injection nozzles should also be designed to provide the proper droplet size (e.g., 50 to 150 microns) to prevent entrainment of non-vaporized components in the vapor product gases, exiting the top of the coking vessel (e.g., coke drum). Typically, these injection nozzles would be aimed countercurrent to the flow of the product vapors. The injection velocity should be sufficient to penetrate the vapors and avoid direct entrainment into the product vapor stream. However, the injection nozzles design and metallurgy must take into account the potential for plugging and erosion from the solids (e.g., catalyst) in the additive package, since the sizing of such solids must be sufficient to avoid entrainment in the product vapor stream.

The additive package of the current invention may also include anti-foam solution that is used by many refiners to avoid foamovers. These antifoam solutions are high density chemicals that typically contain siloxanes to help break up the foam at the vapor/liquid interface by its affect on the surface tension of the bubbles. In many cases, the additive package of the current invention may provide some of the same characteristics as the antifoam solution; significantly reducing the need for separate antifoam. In addition, the existing antifoam system may no longer be necessary in the long term, but may be modified for commercial trials of the current invention.

Said additive is believed to selectively convert the highest boiling point materials in the product vapors of the coking process by (1) condensing vapors of said highest boiling point materials and increasing the residence time of these chemical compounds in the coking vessel, (2) providing a catalyst to reduce the activation energy of cracking for condensed vapors that have a higher propensity to crack (vs. coke), and (3) providing a catalyst and excess reactant to promote the coking of these materials that have a higher propensity to coking (vs. cracking). That is, the localized quench effect of the additive would cause the highest boiling point components (heavy aromatics) in the vapors to condense on the catalyst and/or seeding agent, and cause selective exposure of the heavy aromatics to the catalysts' active sites. If the heavy aromatic has a higher propensity to crack, selective cracking will occur, the cracked liquids of lower boiling point will vaporize and leave the catalyst active site. This vaporization causes another localized cooling effect that condenses the next highest boiling point component. Conceivably, this repetitive process continues until the catalyst active site encounters a condensed component that has a higher propensity to coke (vs. crack) in the particular coking vessel's operating conditions or the coking cycle ends. Equilibrium for the catalytic cracking (vs. coking) of heavy aromatics has been shown to favor lower temperatures (e.g., 800 to 850° F. vs. 875 to 925° F.), if given sufficient residence time and optimal catalyst porosity and activity levels. The additive settling time and the time at or below the vapor/liquid interface provide much longer residence times than encountered in other catalytic cracking units (e.g., FCCU). Thus, the ability to crack heavy aromatics is enhanced by this method of catalytic cracking. Ideally, the additive's active sites in many applications would crack many molecules of heavy aromatics, prior to and after reaching the vapor/liquid interface, before selectively coking heavy aromatic components and being integrated into the petroleum coke. This invention should not be limited by this theory of operation. However, both the injection of this type of additive package and the selective cracking and coking of heavy aromatics are contrary to conventional wisdom and current trends in the petroleum coking processes.

Enhancement of Additive Effectiveness:

It has also been discovered that minor changes in coking process operating conditions may enhance the effectiveness of the additive package. The changes in coker operating conditions include, but should not be limited to, (1) reducing the coking vessel outlet temperature, (2) increasing the coking vessel outlet pressure, (3) reducing the coking feed heater outlet temperature, or (4) any combination thereof. The first two operational changes represent additional means to condense the highest boiling point materials in the product vapors to increase their residence time in the coking vessel. In many cases, the additive package is already lowering the temperature of the product vapors by its quenching effect and the intentional inclusion of a quenching agent in the additive package to increase this quenching effect. However, many coking units have a substantial quench of the product vapors in the vapor line between the coking vessel and the fractionator to prevent coking of these lines. In many cases, it may be desirable to move some of this quench upstream into the coking vessel. In some coking units, this may be accomplished by simply changing the direction of the quench spray nozzle (e.g., countercurrent versus cocurrent). As noted previously, a commensurate reduction in the downstream vapor quenching is often desirable to maintain the same overall heat balance in the coking process unit. If the coking unit is not pressure (compressor) limited, slightly increasing the coking vessel pressure may be preferable in many cases due to less vapor loading (caused by the quenching effect) to the fractionator and its associated problems. Finally, slight reductions of the feed heater outlet temperature may be desirable in some cases to optimize the use of the additive in exemplary embodiments of the present invention. In some cases, reduction of the cracking of heavy aromatics and asphaltenes to these 'heavy tail' components may reduce the amount of additive required to remove the 'heavy tail' and improve its effectiveness in changing coke morphology from shot coke to sponge coke crystalline structure. In some cases, other operational changes in the coking process may be desirable to improve the effectiveness of some exemplary embodiments of the present invention.

In the practical application of an exemplary embodiment of the present invention, the optimal combination of methods and embodiments will vary significantly. That is, site-specific, design and operational parameters of the particular coking process and refinery must be properly considered. These factors include (but should not be limited to) coker design, coker feedstocks, and effects of other refinery operations.

DRAWINGS

FIG. 1 shows an example of the present invention in its simplest form. This basic process flow diagram shows a heated, mixing tank where components of an exemplary embodiment of the present invention's additive may be blended: catalyst(s), seeding agent(s), excess reactant(s), carrier fluid(s), and/or quenching agent(s). The mixed additive is then injected into a generic coking vessel via a properly sized pump and piping, preferably with a properly sized atomizing injection nozzle.

Figure 2:
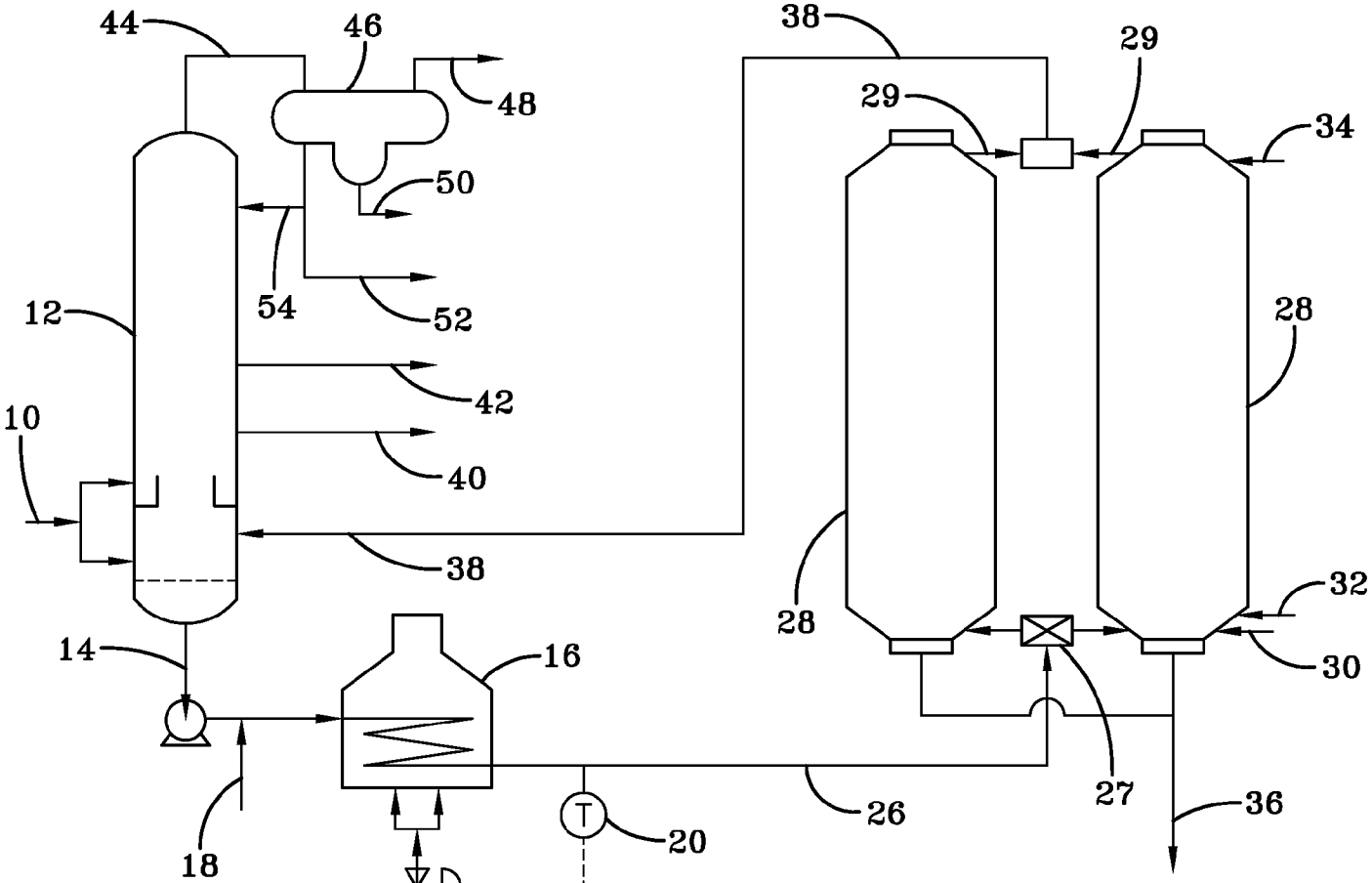

FIG. 2 shows a basic process flow diagram of the traditional, delayed coking technology of the known art.

Figure 3:
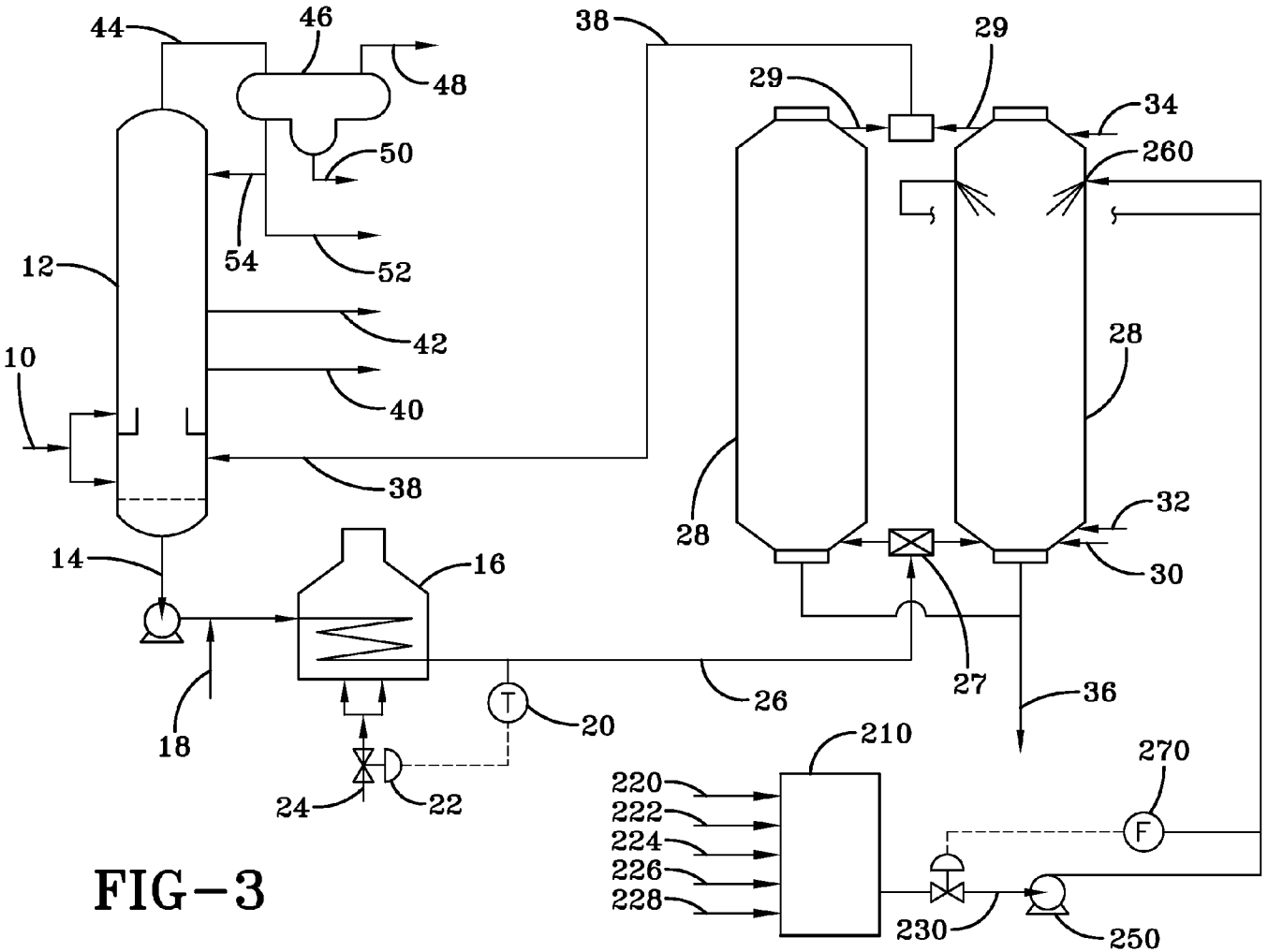

FIG. 3 shows the integration of an example of an additive injection system of the present invention into the delayed coking process. The actual additive injection system will vary from refinery to refinery, particularly in retrofit applications. The injection points may be through injection nozzles at one or more points on the side walls above the vapor/liquid interface (also above the coking interface) in the coking vessel. Alternatively, the injection of the additive may take place at various places above the vapor/liquid interface. For example, lances from the top of the coke drum or even a coke stem that moves ahead of the rising vapor/liquid interface (e.g., coking mass). Also, the additive injection system may be integrated as part of the existing anti-foam system (i.e., modified anti-foam system to increase flow rates), take the place of the anti-foam system, or be a totally independent system.

Figure 4:
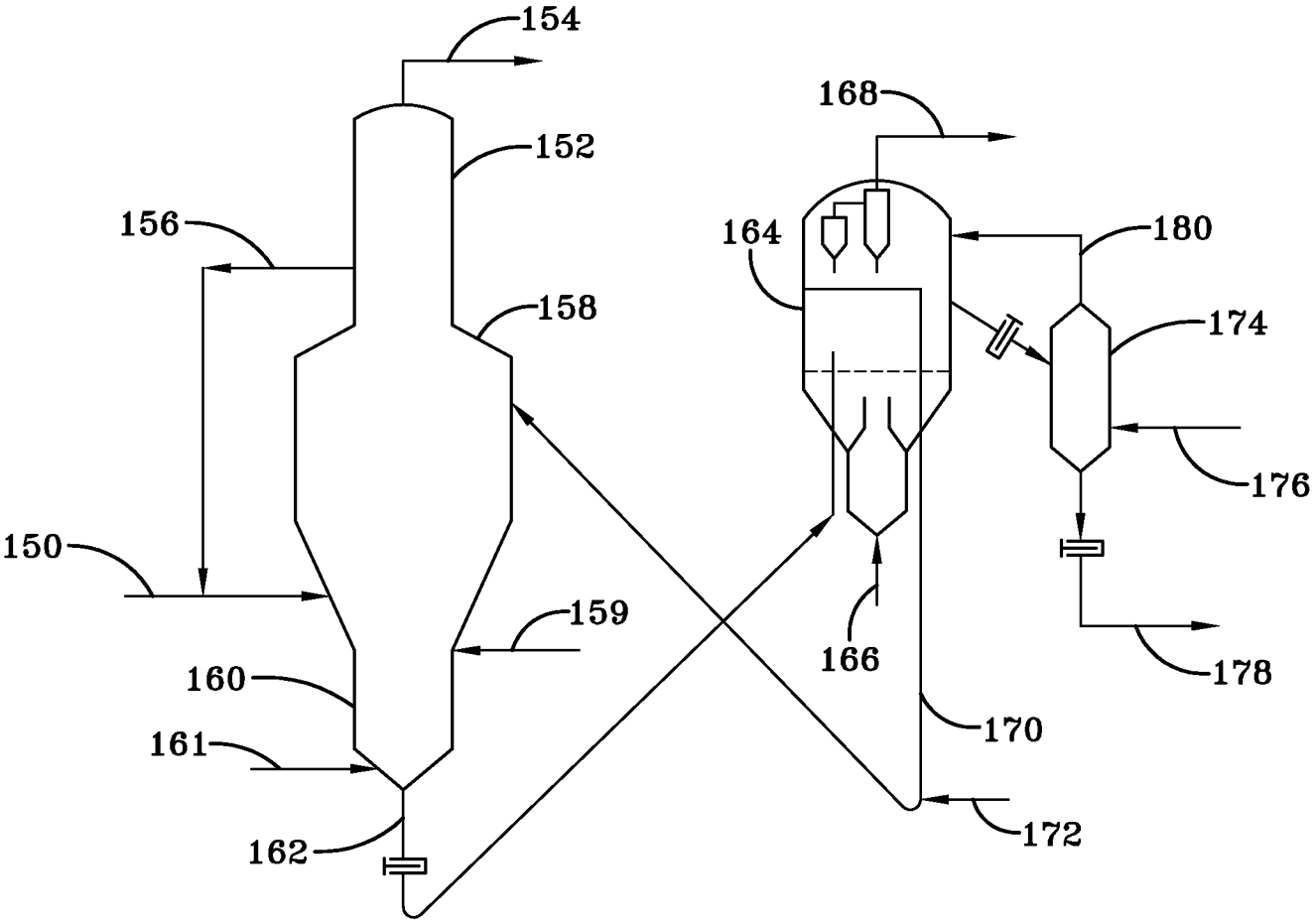

FIG. 4 shows a basic process flow diagram of the traditional, Fluid Coking® technology of the known art. Flexicoking® is essentially the same process with an additional gasifier vessel for the gasification of the by-product pet coke.

Figure 5:
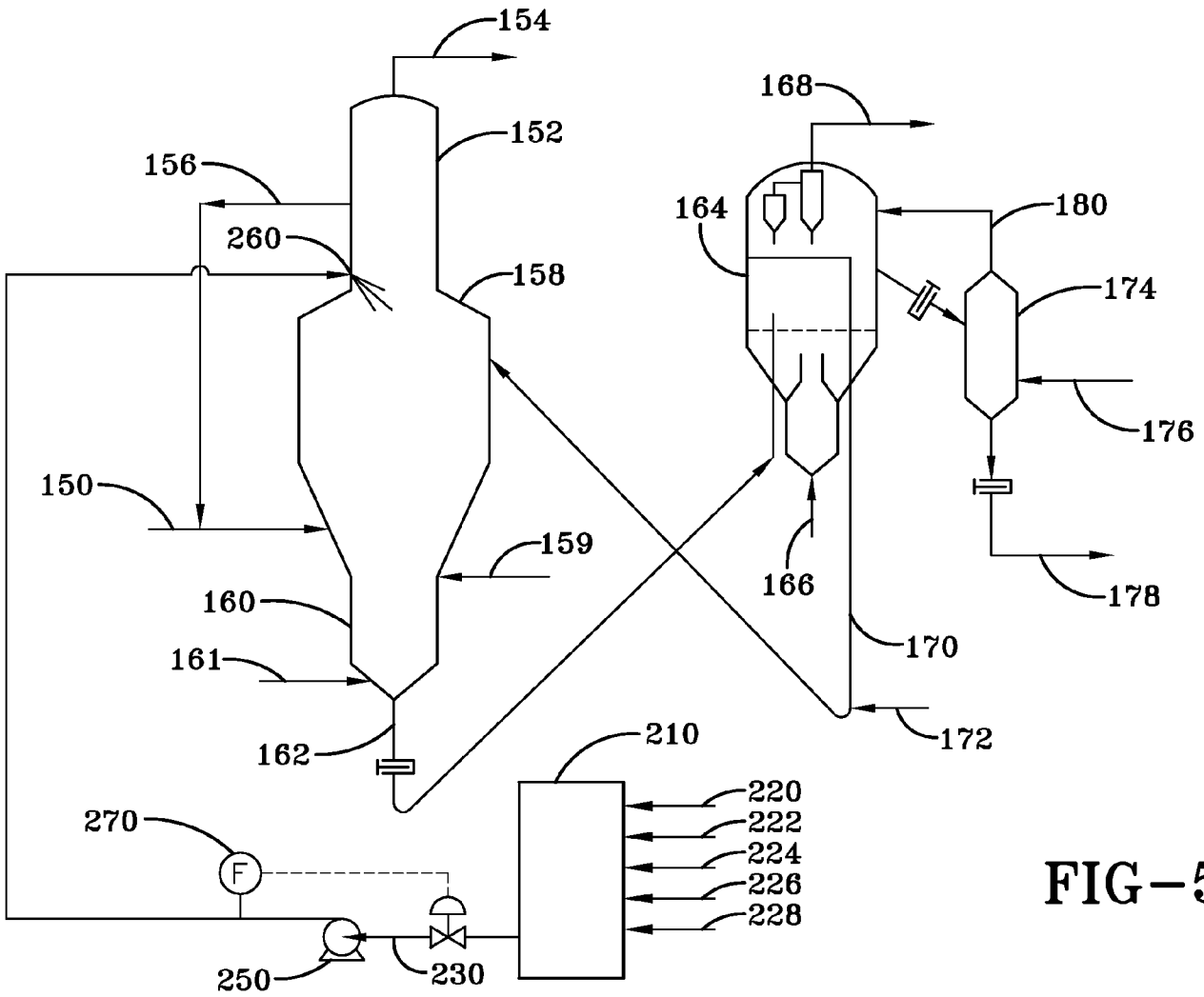

FIG. 5 shows the integration of an example of an additive injection system of the present invention into the Fluid Coking® and Flexicoking® processes. Similar to the additive system for the delayed coking process, the additive may be injected into the coking vessel above the level where the product vapors separate from the liquid and coke particles (i.e., coking interface in this case). Again, the actual additive injection system will vary from refinery to refinery, particularly in retrofit applications.

DETAILED DESCRIPTION OF THE EXEMPLARY EMBODIMENT(S)

In view of the foregoing summary, the following presents a detailed description of exemplary embodiments of the present invention, currently considered the best mode of practicing the present invention. The detailed description of the exemplary embodiments of the invention provide a discussion of the invention relative to the drawings. The detailed descriptions and discussion of the exemplary embodiments is divided into two major subjects: General Exemplary Embodiment and Other Embodiments. These embodiments discuss and demonstrate the ability to modify (1) the quality or quantity of the additive package and/or (2) change the coking process operating conditions to optimize the use of an exemplary embodiment of the present invention to achieve the best results in various coking process applications.

Description and Operation of Exemplary Embodiments of the Invention

General Exemplary Embodiment

FIG. 1 provides a visual description of an exemplary embodiment of the present invention in its simplest form.

This basic process flow diagram shows a heated, mixing tank (210) where components of an example of the present invention's additive may be blended: catalyst(s) (220), seeding agent(s) (222), excess reactant(s) (224), carrier fluid(s) (226), and/or quenching agent(s) (228). The mixed additive (230) is then injected into a generic coking vessel (240) above the vapor/liquid-solid interface via properly sized pump(s) (250) and piping, preferably with properly sized atomizing injection nozzle(s) (260). In this case, the pump is controlled by a flow meter (270) with a feedback control system relative to the specified set point for additive flow rate. The primary purpose of this process is to consistently achieve the desired additive mixture of components of an example of the present invention and evenly distribute this additive throughout the cross sectional area of the coking vessel to provide adequate contact with the product vapors, (rising from the vapor/liquid interface) to quench the vapors (e.g., 5-15° F.) and condense the heavier aromatics onto the catalyst or seeding agent. Much of the additive slurry, particularly the quenching agent(s), will vaporize upon injection, but heavier liquids (e.g., carrier fluid, excess reactants, etc.) and the solids would be of sufficient size to gradually settle to the vapor/liquid interface, creating the desired effect of selectively converting the highest boiling point components of the product vapors. In general, the system should be designed to (1) handle the process requirements at the point(s) of injection and (2) prevent entrainment of the additive's heavier components (e.g., catalyst) into downstream equipment. Certain characteristics of the additive (after vaporization of lighter components) will be key factors to minimize entrainment: density, particle size of the solids (e.g., >40 microns) and atomized droplet size (e.g., 50 to 150 microns).

As noted in the invention summary, the specific design of this system and the optimal blend of additive components will vary among refineries due to various factors. The optimal blend may be determined in pilot plant studies or commercial demonstrations of this invention (e.g., using the existing antifoam system, modified for higher flow rate). Once this is determined, one skilled in the art may design this system to reliably control the quality and quantity of the additive components to provide a consistent blend of the desired mixture. This may be done on batch or continuous basis. One skilled in the art may also design and operating procedures for the proper piping, injection nozzles, and pumping system, based on various site specific factors, including (but not limited to) (1) the characteristics of the additive mixture (e.g., viscosity, slurry particle size, etc.), (2) the requirements of the additive injection (e.g., pressure, temperature, etc.) and (3) facility equipment requirements in their commercial implementation (e.g., reliability, safety, etc.).

The operation of the equipment in FIG. 1 is straightforward, after the appropriate additive mixture has been determined. The components are added to the heated (e.g., steam coils), mixing tank with their respective quality and quantity as determined in previous tests (e.g., commercial demonstration). Whether the mixing is a batch or continuous basis, the injection of the additive of this invention is continually injected into the coking vessel while the coking process proceeds. In the semi-continuous process of the delayed coking, continuous injection occurs in the drums that are in the coking cycle. However, in these cases, injection at the beginning and end of the coking cycles may not be preferable due to warm up and antifoam issues. Preferably, the flow rate of the additive of an example of the present invention will be proportional to the flow rate of the coker feed (e.g., 1.5 wt. %) and may be adjusted accordingly as the feed flow rate changes.

In the general exemplary embodiment, the additive package is designed with first priority given to selectively crack the high boiling point components in the coking vessel product vapors. Then, second priority is given to selectively coke the remaining high boiling point components. In other words, the additive will condense and selectively remove these high boiling point components from the product vapors and help them either crack or coke, with preference given to cracking versus coking. This is primarily achieved by the choice of catalyst. For example, residua cracking catalysts that are traditionally used for cracking in catalytic cracking units (e.g., Fluid Catalytic Cracking Unit or FCCU) may be very effective in this application to crack the heavy aromatics molecules into lighter 'cracked liquids'. These catalysts have a higher degree of mesoporosity and other characteristics that allow the large molecules of the high boiling point components to have better access to and from the catalyst's active cracking sites. In addition, the other components of the additive package may influence cracking reactions over coking reactions, as well. As described previously, it is anticipated that various catalysts will be designed for the purposes above, particularly catalysts to achieve greater cracking of the highest boiling point materials in the coking process product vapors. In many cases, conversion of the highest boiling point product vapors to coke may predominate (e.g., >70 Wt. %) due to their higher propensity to coke (vs. crack). However, with certain chemical characteristics of these materials, properly designed catalysts, and the proper coker operating conditions, substantial conversion of these materials to cracked liquids may be accomplished (e.g., >50 Wt. %). Conceivably, cracking of heavy aromatics (that would otherwise become coke, recycle material, or 'heavy tail' of the heavy coker gas oil) could be sufficient to reduce overall coke production, reduce coker recycle, and/or reduce heavy gas oil production, particularly the 'heavy tail' components.

In many cases, the achievement of additional cracking of these highest boiling point materials in the product vapors to 'cracked liquids' products is worth the cost of fresh cracking catalyst versus spent or regenerated catalyst. This economic determination will depend on the chemical structures of the high boiling point components. That is, many of these high boiling point components often has a high propensity to coke and will coke rather than crack, regardless of the additive package design. If sufficient high boiling point components are of this type, the economic choice of catalyst may include spent, catalyst(s), regenerated catalyst(s), fresh catalyst(s), or any combination thereof. In a similar manner, cracking catalysts, in general, may not be desirable in cases where almost all of the high boiling point components have very high propensities to coke, and inevitably become coke, regardless of the additive package design.

In its preferred embodiment, this additive selectively cracks the heavy coker gas oil's heaviest aromatics that have the highest propensity to coke, while quenching cracking reactions in the vapor, initiating cracking reactions in the condensed vapors, and/or provides antifoaming protection.

Description and Operation of Alternative Exemplary Embodiments

Delayed Coking Process

There are various ways exemplary embodiments of the present invention may improve the delayed coking process. A detailed description of how the invention is integrated into the delayed coking process is followed by discussions of its operation in the delayed coking process and alternative exemplary embodiments relative to its use in this common type of coking process.

Traditional Delayed Coking Integrated with Exemplary Embodiments of the Present Invention FIG. 2 is a basic process flow diagram for the traditional delayed coking process of the prior art. Delayed coking is a semi-continuous process with parallel coking drums that alternate between coking and decoking cycles. Exemplary embodiments of the present invention integrate an additive injection system into the delayed coking process equipment. The operation with an example of the present invention is similar, as discussed below, but significantly different.

In general, delayed coking is an endothermic reaction with the furnace supplying the necessary heat to complete the coking reaction in the coke drum. The exact mechanism of delayed coking is so complex that it is not possible to determine all the various chemical reactions that occur, but three distinct steps take place:

1. Partial vaporization and mild cracking of the feed as it passes through the furnace
2. Cracking of the vapor as it passes through the coke drum
3. Successive cracking and polymerization of the heavy liquid trapped in the drum until it is converted to vapor and coke.

In the coking cycle, coker feedstock is heated and transferred to the coke drum until full. Hot residua feed 10 (most often the vacuum tower bottoms) is introduced into the bottom of a coker fractionator 12, where it combines with condensed recycle. This mixture 14 is pumped through a coker heater 16, where the desired coking temperature (normally between 900.degree. F. and 950.degree. F.) is achieved, causing partial vaporization and mild cracking. Steam or boiler feed water 18 is often injected into the heater tubes to prevent the coking of feed in the furnace. Typically, the heater outlet temperature is controlled by a temperature gauge 20 that sends a signal to a control valve 22 to regulate the amount of fuel 24 to the heater. A vapor-liquid mixture 26 exits the heater, and a control valve 27 diverts it to a coking drum 28. Sufficient residence time is provided in the coking drum to allow thermal cracking and coking reactions to proceed to completion. By design, the coking reactions are "delayed" until the heater charge reaches the coke drums. In this manner, the vapor-liquid mixture is thermally cracked in the drum to produce lighter hydrocarbons, which vaporize and exit the coke drum. The drum vapor line temperature 29 (i.e., temperature of the vapors leaving the coke drum) is the measured parameter used to represent the average drum temperature. Petroleum coke and some residuals (e.g., cracked hydrocarbons) remain in the coke drum. When the coking drum is sufficiently full of coke, the coking cycle ends. The heater outlet charge is then switched from the first coke drum to a parallel coke drum to initiate its coking cycle. Meanwhile, the decoking cycle begins in the first coke drum. Lighter hydrocarbons 38 are vaporized, removed overhead from the coking drums, and transferred to a coker fractionator 12, where they are separated and recovered. Coker heavy gas oil (HGO) 40 and coker light gas oil (LGO) 42 are drawn off the fractionator at the desired boiling temperature ranges: HGO: roughly 650-870.degree. F.; LGO: roughly 400-650.degree. F. The fractionator overhead stream, coker wet gas 44, goes to a separator 46, where it is separated into dry gas 48, water 50, and unstable naphtha 52. A reflux fraction 54 is often returned to the fractionator.

In the decoking cycle, the contents of the coking drum are cooled down, remaining volatile hydrocarbons are removed, the coke is drilled from the drum, and the coking drum is prepared for the next coking cycle. Cooling the coke normally occurs in three distinct stages. In the first stage, the coke is cooled and stripped by steam or other stripping media 30 to economically maximize the removal of recoverable hydrocarbons entrained or otherwise remaining in the coke. In the second stage of cooling, water or other cooling media 32 is injected to reduce the drum temperature while avoiding thermal shock to the coke drum. Vaporized water from this cooling media farther promotes the removal of additional vaporizable hydrocarbons. In the final cooling stage, the drum is quenched by water or other quenching media 34 to rapidly lower the drum temperatures to conditions favorable for safe coke removal. After the quenching is complete, the bottom and top heads of the drum are removed. The petroleum coke 36 is then cut, typically by a hydraulic water jet, and removed from the drum. After coke removal, the drumheads are replaced, the drum is preheated, and otherwise readied for the next coking cycle.

Exemplary embodiments of the present invention may be readily integrated into the traditional, delayed coker system, both new and existing. As shown in FIG. 3, this process flow diagram shows the traditional delayed coking system of FIG. 2 with the addition of an example of the present invention. This simplified example shows the addition of a heated, mixing tank (210) where exemplary components of the present invention's additive may be blended: catalyst(s) (220), seeding agent(s) (222), excess reactant(s) (224), carrier fluid(s) (226), and/or quenching agent(s) (228). The mixed additive (230) is then injected into the upper coke drums (28) above the vapor/liquid interface of the delayed coking process via properly sized pump(s) (250) and piping, preferably with properly sized atomizing injection nozzle(s) (260). In this case, the pump is controlled by a flow meter (270) with a feedback control system relative to the specified set point for additive flow rate.

Process Control of Traditional Delayed Coking with Exemplary Embodiments of the Present Invention In traditional delayed coking, the optimal coker operating conditions have evolved through the years, based on much experience and a better understanding of the delayed coking process. Operating conditions have normally been set to maximize (or increase) the efficiency of feedstock conversion to cracked liquid products, including light and heavy coker gas oils. More recently, however, the cokers in some refineries have been changed to maximize (or increase) coker throughput.

In general, the target operating conditions in a traditional delayed coker depend on the composition of the coker feedstocks, other refinery operations, and coker design. Relative to other refinery processes, the delayed coker operating conditions are heavily dependent on the feedstock blends, which vary greatly among refineries (due to varying crude blends and processing scenarios). The desired coker products and their required specifications also depend greatly on other process operations in the particular refinery. That is, downstream processing of the coker liquid products typically upgrades them to transportation fuel components. The target operating conditions are normally established by linear programming (LP) models that optimize the particular refinery's operations. These LP models typically use empirical data generated by a series of coker pilot plant studies. In turn, each pilot plant study is designed to simulate the particular refinery's coker design. Appropriate operating conditions are determined for a particular feedstock blend and particular product specifications set by the downstream processing requirements. The series of pilot plant studies are typically designed to produce empirical data for operating conditions with variations in feedstock blends and liquid product specification requirements. Consequently, the coker designs and target operating conditions vary significantly among refineries.

In common operational modes, various operational variables are monitored and controlled to achieve the desired delayed coker operation. The primary independent variables are feed quality, heater outlet temperature, coke drum pressure, and fractionator hat temperature. The primary dependent variables are the recycle ratio, the coking cycle time and the drum vapor line temperature. The following target control ranges are normally maintained during the coking cycle for these primary operating conditions:

1. Heater outlet temperatures in range of about 900 degree F. to about 950 degree F.,
2. Coke drum pressure in the range of about 15 psig to 100 psig: typically 20-30 psig,
3. Hat Temperature: Temperature of vapors rising to gas oil drawoff tray in fractionator
4. Recycle Ratio in the range of 0-100%; typically 10-20%
5. Coking cycle time in the range of about 12 to 24 hours; typically 15-20 hours
6. Drum Vapor Line Temperature 50 to 100 degree F. less than the heater outlet temperature: typically 850-900 degree F.

These traditional operating variables have primarily been used to control the quality of the cracked liquids and various yields of products. Throughout this discussion, "cracked liquids" refers to hydrocarbon products of the coking process that have 5 or more carbon atoms. They typically have boiling ranges between 97 and 870 degree F., and are liquids at standard conditions. Most of these hydrocarbon products are valuable transportation fuel blending components or feedstocks for further refinery processing. Consequently, cracked liquids are normally the primary objective of the coking process.

Over the past ten years, some refineries have switched coker operating conditions to maximize (or increase) the coker throughput, instead of maximum efficiency of feedstock conversion to cracked liquids. Due to processing heavier crude blends, refineries often reach a limit in coking throughput that limits (or bottlenecks) the refinery throughput. In order to eliminate this bottleneck, refiners often change the coker operating conditions to maximize (or increase) coker throughput in one of three ways:

1. If coker is fractionator (or vapor) limited, increase drum pressure (e.g., 15 to 20 psig.)
2. If coker is drum (or coke make) limited, reduce coking cycle time (e.g., 16 to 12 hours)
3. If Coker is heater (or feed) limited, reduce recycle (e.g., 15 wt. % to 12 wt. %)

All three of these operational changes increase the coker throughput. Though the first two types of higher throughput operation reduce the efficiency of feedstock conversion to cracked liquids (i.e., per barrel of feed basis), they may maximize (or increase) the overall quantity (i.e., barrels) of cracked liquids produced. These operational changes also tend to increase coke yield and coke VCM. However, any increase in drum pressure or decrease in coker cycle time is usually accompanied by a commensurate increase in heater outlet and drum vapor line temperatures to offset (or limit) any increases in coke yield or VCM. In contrast, the reduction in recycle is often accomplished by a reduction in coke drum pressure and an increase in the heavy gas oil end point (i.e., highest boiling point of gas oil). The gas oil end point is controlled by refluxing the trays between the gas oil drawoff and the feed tray in the fractionator with partially cooled gas oil. This operational mode increases the total liquids and maintains the efficiency of feedstock conversion to cracked liquids (i.e., per barrel of feed basis). However, the increase in liquids is primarily highest boiling point components (i.e., 'heavy tail') that are undesirable in downstream process units. In this manner, ones skilled in the art of delayed coking may adjust operation to essentially transfer these highest boiling point components to either the recycle (which reduces coker throughput) or the 'heavy tail' of the heavy gas oil (which decreases downstream cracking efficiency). An exemplary embodiment of the present invention provides the opportunity to (1) increase coker throughput (regardless of the coker section that is limiting), (2) increase liquid yields, and (3) may substantially reduce highest boiling point components in either recycle, heavy gas oil, or both. In this manner, each application of an exemplary embodiment of the present invention may determine which process is preferable to reduce the undesirable, highest boiling point components.

Impact of Present Invention on Delayed Coking Process

There are various ways examples of the present invention may improve existing or new delayed coking processes in crude oil refineries and upgrading systems for synthetic crudes. These novel improvements include, but should not be limited to, (1) catalytic cracking of heavy aromatics that would otherwise become pet coke, recycle, or heavy tail' components of the heavy gas oil, (2) catalytic coking of heavy aromatics in a manner that promotes sponge coke morphology and reduces 'hotspots' in coke cutting, (3) quenching drum outlet gases that reduce 'vapor overcracking', (4) debottlenecking all major sections of the delayed coking process (i.e., heater, drum, & fractionator sections, and (5) reducing recycle and vapor loading of fractionator.

In all the examples for delayed coking processes, an exemplary embodiment of the present invention may achieve one or more of the following: (1) improved coker gas oil quality, (2) improved coke quality and market value, (3) less gas production, (4) less coke production, (5) increased coker and refinery capacities, (6) increased use of cheaper, lower quality crudes and/or coker feeds, (7) increased efficiency and run time of downstream cracking units, (8) decreased operation & maintenance cost of coker and downstream cracking units, and (9) reduced incidents of 'hotspots' in pet coke drum cutting, and (10) reduced catalyst make-up and emissions in downstream cracking units.

Example 1

In fuel grade coke applications, the delayed coking feedstocks are often residuals derived from heavy, sour crude, which contain higher levels of sulfur and metals. As such, the sulfur and metals (e.g., vanadium and nickel) are concentrated in the pet coke, making it usable only in the fuel markets. Typically, the heavier, sour crudes tend to cause higher asphaltene content in the coking process feed. Consequently, the undesirable 'heavy tail' components (e.g., PAHs) are more prominent and present greater problems in downstream catalytic units (e.g., cracking). In addition, the higher asphaltene content (e.g., >15 wt. %) often causes a shot coke crystalline structure, which may cause coke cutting 'hot spots' and difficulties in fuel pulverization.

In these systems, an example of the present invention provides the selective cracking and coking of the 'heavy tail' components (e.g., PAHs) in coker gas oil of the traditional delayed coking process. Typically, gas oil end points are selectively reduced from over 950 degrees of Fahrenheit to 900 degrees of Fahrenheit or less (e.g., preferably <850 degrees of Fahrenheit in some cases). With greater amounts of additive, additional heavy components of the heavy coker gas oil and the coker recycle will be selectively cracked or coked. This improves coker gas oil quality/value and the performance of downstream cracking operations. In addition, the selective cracking of PAHs and quench (thermal & chemical) of the vapor overcracking improves the value of the product yields and increases the 'cracked liquids' yields. Also, the reduction of heavy components that have a high propensity to coke reduces the buildup of coke in the vapor lines and allows the reduction of recycle and heater coking.

With a properly designed additive package (e.g., catalyst & excess reactants), an example of the present invention may also be effectively used to alleviate problems with 'hot spots' in the coke drums of traditional delayed coking. That is, the heavy liquids that remain in the pet coke and cause the 'hot spots' during the decoking cycle (e.g., coke cutting) are encouraged to further crack (preferable) or coke by the catalyst and excess reactants in the additive package. To this end, catalyst(s) and excess reactant(s) for this purpose may include, but should not be limited to, FCCU catalysts, hydrocracker catalysts, activated carbon, crushed coke, FCCU slurry oil, and coker heavy gas oil.

In fuel grade applications, the choice of catalyst(s) in the additive package has greater number of options, since the composition of the catalyst (e.g., metals) is less of an issue in fuel grade pet coke specifications (e.g., vs. anode). Thus, the catalyst may contain substrates and exotic metals to preferentially and selectively crack (vs. coke) the undesirable, heavy hydrocarbons (e.g., PAHs). Again, catalyst(s) and excess reactant(s) for this purpose may include, but should not be limited to, FCCU catalysts, hydrocracker catalysts, iron, activated carbon, crushed coke, FCCU slurry oil, and coker heavy gas oil. The most cost effective catalyst(s) may include spent or regenerated catalysts from downstream units (e.g., FCCU, hydrocracker, and hydrotreater) that have been sized and injected in a manner to prevent entrainment in coking process product vapors to the fractionator. In fact, the nickel content of hydrocracker catalyst may be very effective in selectively coking the undesirable, heavy components (e.g., PAHs) of coker gas oil. The following example is given to illustrate a cost effective source of catalyst for an exemplary embodiment of the present invention. A certain quantity of FCCU equilibrium catalyst of the FCCU is normally disposed of on a regular basis (e.g., daily) and replaced with fresh FCCU catalyst to keep activity levels up. The equilibrium catalyst is often regenerated prior to disposal and could be used in an exemplary embodiment of the present invention to crack the heavy aromatics, particularly if the FCCU catalyst is designed to handle residua in the FCCU feed. If the equilibrium catalyst does not provide sufficient cracking catalyst activity, it could be blended with a new catalyst (e.g., catalyst enhancer) to achieve the desired activity while maintaining acceptable catalyst costs.

When applied to greater degrees, an example of the present invention may also be used to improve the coke quality while improving the value of coke product yields and improved operations and maintenance of the coker and downstream units. That is, continually increasing the additive package will incrementally crack or coke the heaviest remaining vapors. The coking of these components will tend to push coke morphology toward sponge coke and increased VCM. In addition, with the proper additive package the additional VCM will be preferentially greater than 950 degrees Fahrenheit theoretical boiling point.

Example 2

In anode grade coke applications, examples of the present invention may provide substantial utility for various types of anode grade facilities: (1) refineries that currently produce anode coke, but want to add opportunity crudes to their crude blends to reduce crude costs and (2) refineries that produce pet coke with sufficiently low sulfur and metals, but shot coke content is too high for anode coke specifications. In both cases, examples of the present invention may be used to reduce shot coke content to acceptable levels, even with the presence of significant asphaltenes (e.g., >15 wt. %) in the coker feed.

With an exemplary embodiment of the present invention, refineries that currently produce anode quality coke may often add significant levels of heavy, sour opportunity crudes (e.g., >5 wt. %) without causing shot coke content higher than anode coke specifications. That is, an exemplary embodiment of the present invention converts the highest boiling point materials in the product vapors in a manner that preferably produces sponge coke crystalline structure (coke morphology) rather than shot coke crystalline structure. Thus, these refineries may reduce crude costs without sacrificing anode quality coke and its associated higher values.

With an exemplary embodiment of the present invention, refineries that currently produce shot coke content above anode coke specifications may reduce shot coke content to acceptable levels in many cases. That is, an exemplary embodiment of the present invention converts the highest boiling point materials in the product vapors in a manner that preferably produces sponge coke crystalline structure (coke morphology) rather than shot coke crystalline structure. Thus, these refineries may increase the value of its petroleum coke while maintaining or improving coker product yields and coker operation and maintenance.

In both anode coke cases, the additive package must be designed to minimize any increases in the coke concentrations with respect to sulfur, nitrogen, and metals that would add impurities to the aluminum production process. Thus, the selection of catalyst(s) for these cases would likely include alumina or carbon based (e.g., activated carbon or crushed coke) catalyst substrates.

In both anode coke cases, the additive package must be designed to minimize the increase in VCMs and/or preferably produces additional VCMs with theoretical boiling points greater than 1250 degrees Fahrenheit. Thus, catalyst(s) and excess reactants for this additive package would be selected to promote the production of sponge coke with higher molecular weights caused by significant polymerization of the highest boiling point materials in the product vapors and the excess reactants. In these cases, an optimal level of VCMs greater than 1250 degrees Fahrenheit may be desirable to (1) provide volatilization downstream of the upheat zone in the coke calciner and (2) cause recoking of these volatile materials in the internal pores of the calcined coke. The resulting calcined coke will preferably have a substantially greater vibrated bulk density and require less pitch binder to be adsorbed in the coke pores to produce acceptable anodes for aluminum production facilities. In this manner, a superior anode coke may be produced that lowers anode production costs and improves their quality. Beyond this optimal level of VCMs greater than 1250 degrees Fahrenheit, any coke produced by an exemplary embodiment of the present invention will preferably not contain any VCMs. That is, any further coke produced will all have theoretical boiling points greater than 1780 degrees Fahrenheit, as determined by the ASTM test method for VCMs.

Example 3

In needle coke applications, the coking process uses special coker feeds that preferably have high aromatic content, but very low asphaltene content. These types of coker feeds are necessary to achieve the desired needle coke crystalline structure. These delayed coker operations have higher than normal heater outlet temperatures and recycle rates. With an exemplary embodiment of the present invention, these coking processes may maintain needle coke crystalline structure with higher concentrations of asphaltenes and lower concentrations of aromatics in the coker feed. Also, an exemplary embodiment of the present invention may reduce the recycle rate required to produce the needle coke crystalline structure, potentially increasing the coker capacity and improving coker operations and maintenance. In this manner, an exemplary embodiment of the present invention may decrease coker feed costs, while potentially increasing needle coke production and profitability.

Example 4

Some delayed coker systems have the potential to produce petroleum coke for certain specialty carbon products, but do not due to economic and/or safety concerns. These specialty carbon products include (but should not be limited to) graphite products, electrodes, and steel production additives. An exemplary embodiment of the present invention allows improving the coke quality for these applications, while addressing safety concerns and improving economic viability. For example, certain graphite product production processes require a petroleum coke feed that has higher VCM content and preferably sponge coke crystalline structure. An exemplary embodiment of the present invention may be optimized to safely and economically produce the pet coke meeting the unique specifications for these applications. Furthermore, the quality of the VCMs may be adjusted to optimize the graphite production process and/or decrease process input costs.

Fluid Coking and FlexiCoking Processes

An exemplary embodiment of the present invention may also provide significant improvements in other coking technologies, including the Fluid Coking® and Flexicoking® processes. The Flexicoking® process is essentially the Fluid Coking® process with the addition of a gasifier vessel for gasification of the petroleum coke. A detailed description of how an exemplary embodiment of the present invention is integrated into the Fluid Coking® and Flexicoking® processes is followed by discussions of its operation in the Fluid Coking® and Flexicoking® processes and alternative exemplary embodiments relative to its use in these types of coking processes.

Traditional Fluid Coking® and Flexicoking® Integrated with Exemplary Embodiments of the Present Invention FIG. 4 shows a basic process flow diagram for a traditional, Fluid Coking® process. The Flexicoking® process equipment is essentially the same, but has an additional vessel for the gasification of the product coke 178 (remaining 75 to 85% of the coke that is not burned in the Burner 164). Fluid Coking® is a continuous coking process that uses fluidized solids to further increase the conversion of coking feedstocks to cracked liquids, and reduce the volatile content of the product coke. Fluid Coking® uses two major vessels, a reactor 158 and a burner 164.

In the reactor vessel 158, the coking feedstock blend 150 is typically preheated to about 600 to 700 degree F., combined with the recycle 156 from the scrubber section 152, where vapors from the reactor are scrubbed to remove coke fines. The scrubbed product vapors 154 are sent to conventional fractionation and light ends recovery (similar to the fractionation section of the delayed coker). The feed and recycle mixture is sprayed into the reactor 158 onto a fluidized bed of hot, fine coke particles. The mixture vaporizes and cracks, forming a coke film (.about 0.5 um) on the particle surfaces. Since the heat for the endothermic cracking reactions is supplied locally by these hot particles, this permits the cracking and coking reactions to be conducted at higher temperatures of about 510.degree. C.-565.degree. C. or (950.degree. F.-1050.degree. F.) and shorter contact times (15-30 seconds) versus delayed coking. As the coke film thickens, the particles gain weight and sink to the bottom of the fluidized bed. High-pressure steam 159 is injected via attriters and break up the larger coke particles to maintain an average coke particle size (100-600 um), suitable for fluidization. The heavier coke continues through the stripping section 160, where it is stripped by additional fluidizing media 161 (typically steam). The stripped coke (or cold coke) 162 is then circulated from the reactor 158 to the burner 164.

In the burner, roughly 15-25% of the coke is burned with air 166 in order to provide the hot coke nuclei to contact the feed in the reactor vessel. This coke burn also satisfies the process heat requirements without the need for an external fuel supply. The burned coke produces a low heating value (20-40 Btu/scf) flue gas 168, which is normally burned in a CO Boiler or furnace. Part of the unburned coke (or hot coke) 170 is recirculated back to the reactor to begin the process all over again. A carrier media 172, such as steam, is injected to transport the hot coke to the reactor vessel. In some systems, seed particles (e.g., ground product coke) must be added to these hot coke particles to maintain a particle size distribution that is suitable for fluidization. The remaining product coke 178 must be removed from the system to keep the solids inventory constant. It contains most of the feedstock metals, and part of the sulfur and nitrogen. Coke is withdrawn from the burner and fed into the quench elutriator 174 where product coke (larger coke particles) 178 are removed and cooled with water 176. A mixture 180 of steam, residual combustion gases, and entrained coke fines are recycled back to the burner.

An exemplary embodiment of the present invention may be readily integrated into the traditional, Flexicoking® and Fluid Coking® systems, both new and existing. As shown in FIG. 5, this process flow diagram shows the traditional Flexicoking® system of FIG. 4 with the addition of an example of the present invention. This simplified example shows the addition of a heated, mixing tank (210) where components of an example of the present invention's additive may be blended: catalyst(s) (220), seeding agent(s) (222), excess reactant(s) (224), carrier fluid(s) (226), and/or quenching agent(s) (228). The mixed additive (230) is then injected into the upper coke drums (28) above the vapor/liquid interface of the delayed coking process via properly sized pump(s) (250) and piping, preferably with properly sized atomizing injection nozzle(s) (260). In this case, the pump is controlled by a flow meter (270) with a feedback control system relative to the specified set point for additive flow rate.

A. Process Control of the Known Art

In traditional Fluid Coking®, the optimal operating conditions have evolved through the years, based on much experience and a better understanding of the process. Operating conditions have normally been set to maximize (or increase) the efficiency of feedstock conversion to cracked liquid products, including light and heavy coker gas oils. The quality of the byproduct petroleum coke is a relatively minor concern.

As with delayed coking, the target operating conditions in a traditional fluid coker depend on the composition of the coker feedstocks, other refinery operations, and the particular coker's design. The desired coker products also depend greatly on the product specifications required by other process operations in the particular refinery. That is, downstream processing of the coker liquid products typically upgrades them to transportation fuel components. The target operating conditions are normally established by linear programming (LP) models that optimize the particular refinery's operations. These LP models typically use empirical data generated by a series of coker pilot plant studies. In turn, each pilot plant study is designed to simulate the particular coker design, and determine appropriate operating conditions for a particular coker feedstock blend and particular product specifications for the downstream processing requirements. The series of pilot plant studies are typically designed to produce empirical data for operating conditions with variations in feedstock blends and liquid product specification requirements. Consequently, the fluid coker designs and target operating conditions vary significantly among refineries.

In normal fluid coker operations, various operational variables are monitored and controlled to achieve the desired fluid coker operation. The primary operational variables that affect coke product quality in the fluid coker are the reactor temperature, reactor residence time, and reactor pressure. The reactor temperature is controlled by regulating (1) the temperature and quantity of coke recirculated from the burner to the reactor and (2) the feed temperature, to a limited extent. The temperature of the recirculated coke fines is controlled by the burner temperature. In turn, the burner temperature is controlled by the air rate to the burner. The reactor residence time (i.e., for cracking and coking reactions) is essentially the holdup time of fluidized coke particles in the reactor. Thus, the reactor residence time is controlled by regulating the flow and levels of fluidized coke particles in the reactor and burner. The reactor pressure normally floats on the gas compressor suction with commensurate pressure drop of the intermediate components. The burner pressure is set by the unit pressure balance required for proper coke circulation. It is normally controlled at a fixed differential pressure relative to the reactor. The following target control ranges are normally maintained in the fluid coker for these primary operating variables:

1. Reactor temperatures in the range of about 950 degree F. to about 1050 degree F.,
2. Reactor residence time in the range of 15-30 seconds,
3. Reactor pressure in the range of about 0 psig to 100 psig: typically 0-5 psig,
4. Burner Temperature: typically 100-200 degree F. above the reactor temperature.

These traditional operating variables have primarily been used to control the quality of the cracked liquids and various yields of products, but not the respective quality of the byproduct petroleum coke.

B. Process Control of Exemplary Embodiments of the Present Invention

There are various ways exemplary embodiments of the present invention may improve existing or new Flexicoking® and Fluid Coking® processes in crude oil refineries and upgrading systems for synthetic crudes. These novel improvements include, but should not be limited to, (1) catalytic cracking of heavy aromatics that would otherwise become pet coke, recycle, or heavy tail' components of the heavy gas oil, (2) catalytic coking of heavy aromatics in a manner that promotes better coke morphology, (3) quenching product vapors in a manner that reduce 'vapor overcracking', (4) debottlenecking the heater, and (5) reducing recycle and vapor loading of fractionator.

In all the examples for Flexicoking® and Fluid Coking® processes, an exemplary embodiment of the present invention may achieve one or more of the following: (1) improved coker gas oil quality, (2) improved coke quality and market value, (3) less gas production, (4) less coke production, (5) increased coker and refinery capacities, (6) increased use of cheaper, lower quality crudes and/or coker feeds, (7) increased efficiency and run time of downstream cracking units, (8) decreased operation & maintenance cost of coker and downstream cracking units, and (10) reduced catalyst make-up and emissions in downstream cracking units.

Example 5

In the Fluid Coking and FlexiCoking processes, the coke formation mechanism and coke morphology are substantially different from the delayed coking process. However, the product vapors are transferred from the coking vessel to the fractionator in a manner similar to the delayed coking process. As such, an exemplary embodiment of the present invention may be used in these coking processes to selectively crack and coke the heaviest boiling point materials in these product vapors, as well. An exemplary embodiment of the present invention would still tend to push the pet coke toward sponge coke morphology, but would have less impact on the resulting coke. Also, an exemplary embodiment of the present invention would have less impact on the quantity and quality of the additional VCMs in the pet coke.

As noted previously, the catalyst of the additive of an exemplary embodiment of the present invention may be sized properly (100 to 600 microns) to promote the fluidization of the catalyst to increase the residence time of the catalyst in this system and reduce the amount of catalyst that would be needed for the same level of conversion.

CONCLUSION, RAMIFICATIONS, AND SCOPE OF THE INVENTION

Thus the reader will see that the coking process modification of the invention provides a highly reliable means to catalytically crack or coke the highest boiling point components (e.g., heavy aromatics) in the product vapors exiting the coking vessel. This novel coking process modification provides the following advantages over traditional coking processes and recent improvements: (1) improved coker gas oil quality, (2) improved coke quality and market value, (3) less gas production, (4) less coke production, (5) increased coker and refinery capacities, (6) increased use of cheaper, lower quality crudes and/or coker feeds, (7) increased efficiency and run time of downstream cracking units, (8) decreased operation & maintenance cost of coker and downstream cracking units, and (10) reduced catalyst make-up and emissions in downstream cracking units.

While my above description contains many specificities, these should not be construed as limitations on the scope of the invention, but rather as an exemplification of one preferred embodiment thereof. Many other variations are possible. Accordingly, the scope of the invention should be determined not by the embodiment(s) illustrated, but by the appended claims and their legal equivalents.

What is claimed is:

1. A process comprising introducing an additive consisting essentially of carrier fluid(s), alone or in combination with seeding agent(s), excess reactant(s), quenching agent(s), or any combination thereof, into a coking vessel above a vapor/liquid-solid interface during a coking cycle of a delayed coking process;

wherein said carrier fluid(s) comprises gas oil available at the coking process.

2. The process of claim 1 wherein said carrier fluid(s) comprises liquid, gas, hydrocarbon vapor, or any combination thereof.

3. The process of claim 1 wherein said carrier fluid(s) comprises FCCU slurry oil, FCCU cycle oil, other hydrocarbon(s), other oil(s), inorganic liquid(s), water, steam, nitrogen, or combinations thereof.

4. The process of claim 1 wherein said additive consists essentially of said carrier fluid(s) in combination with said seeding agent(s).

5. The process of claim 4 wherein said seeding agent(s) comprises carbon particles, sodium, calcium, iron, or any combination thereof.

6. The process of claim 1 wherein said additive consists essentially of said carrier fluid(s) in combination with said excess reactant(s).

7. The process of claim 6 wherein said excess reactant(s) comprises chemical compound(s) that is adapted to react with coker product vapors to increase production of gas oils and naphthas, to react with heavy aromatics to form petroleum coke, to react with catalyst to catalytically crack, to react with catalyst to catalytically coke, or any combination thereof, and has physical properties of a liquid, a semi-solid, solid particle, or any combination thereof.

8. The process of claim 1 wherein said additive consists essentially of said carrier fluid(s) in combination with said quenching agent(s).

9. The process of claim 8 wherein said quenching agent(s) is adapted to terminate cracking reactions in a product vapor, thereby reducing excessive cracking of middle distillates to low value gases, and improve production of gas oils and naphthas.

10. The process of claim 8 wherein said quenching agent(s) comprises gas oils, FCCU slurry oil, FCCU cycle oil, other hydrocarbon(s), other oil(s), inorganic liquid(s), water, steam, nitrogen, or combinations thereof.

11. A process comprising introducing an additive consisting essentially of excess reactant(s), alone or in combination with seeding agent(s), carrier fluid(s), quenching agent(s), or any combination thereof, into a coking vessel above a vapor/liquid-solid interface during a coking cycle of a delayed coking process;

wherein said excess reactant(s) is introduced in an amount less than 15 weight percent of a coker feed in the coking vessel.

12. The process of claim 11 wherein said excess reactant(s) comprises chemical compound(s) that is adapted to react with coker product vapors to increase production of gas oils and naphthas, to react with heavy aromatics to form petroleum coke, to react with catalyst to catalytically crack, to react with catalyst to catalytically coke, or any combination thereof, and has physical properties of a liquid, a semi-solid, solid particle, or any combination thereof.

13. The process of claim 11 wherein said excess reactant(s) comprises gas oil, FCCU slurry oil, FCCU cycle oil, extract from an aromatic extraction unit, coker feed, bitumen, other aromatic oil, coke, activated carbon, coal, or any combination thereof.

14. The process of claim 11 wherein said additive consists essentially of said excess reactant(s) in combination with said seeding agent(s).

15. The process of claim 14 wherein said seeding agent(s) comprises carbon particles, sodium, calcium, iron, or any combination thereof.

16. The process of claim 15 wherein said carbon particles comprise coke, activated carbon, coal, or any combination thereof.

17. The process of claim 11 wherein said additive consists essentially of said excess reactant(s) in combination with said carrier fluid(s).

18. The process of claim 17 wherein said carrier fluid(s) comprises gas oil, FCCU slurry oil, FCCU cycle oil, other hydrocarbon(s), other oil(s), inorganic liquid(s), water, steam, nitrogen, or combinations thereof.

19. The process of claim 11 wherein said additive consists essentially of said excess reactant(s) in combination with said quenching agent(s).

20. The process of claim 19 wherein said quenching agent(s) is adapted to terminate cracking reactions in a product vapor, thereby reducing excessive cracking of middle distillates to low value gases, and improve production of gas oils and naphthas.

* * * * *